US010546489B2

(12) United States Patent
Suzuki et al.

(10) Patent No.: US 10,546,489 B2
(45) Date of Patent: Jan. 28, 2020

(54) INFORMATION PROCESSING APPARATUS, INFORMATION PROCESS SYSTEM, AND INFORMATION PROCESS METHOD

(71) Applicants: Kabushiki Kaisha Toshiba, Minato-ku (JP); Toshiba Infrastructure Systems & Solutions Corporation, Kawasaki-shi (JP)

(72) Inventors: Yoshihiko Suzuki, Suginami (JP); Toshio Sato, Yokohama (JP); Yusuke Takahashi, Tama (JP); Hideki Ueno, Urayasu (JP); Yoshikazu Ooba, Hachioji (JP); Hiroshi Sakai, Yokohama (JP)

(73) Assignees: Kabushiki Kaisha Toshiba, Minato-ku (JP); Toshiba Infrastructure Systems & Solutions Corporation, Kawasaki-shi (JP)

( * ) Notice: Subject to any disclaimer, the term of this patent is extended or adjusted under 35 U.S.C. 154(b) by 78 days.

(21) Appl. No.: 15/887,287

(22) Filed: Feb. 2, 2018

(65) Prior Publication Data

US 2018/0374345 A1 Dec. 27, 2018

(30) Foreign Application Priority Data

Jun. 22, 2017 (JP) ..... 2017-121950

(51) Int. Cl.
*G08G 1/01* (2006.01)
*G08G 1/04* (2006.01)

(52) U.S. Cl.
CPC ..... *G08G 1/0125* (2013.01); *G08G 1/0108* (2013.01); *G08G 1/0137* (2013.01); *G08G 1/04* (2013.01)

(58) Field of Classification Search
CPC .. G08G 1/0125; G08G 1/0112; G08G 1/0133; G08G 1/0137; G08G 1/04; G08G 1/0108
USPC ..... 701/117
See application file for complete search history.

(56) References Cited

U.S. PATENT DOCUMENTS

| | | | | |
|---|---|---|---|---|
| 6,061,625 | A | 5/2000 | Fastenrath | |
| 9,607,454 | B1 | 3/2017 | Raghu et al. | |
| 2013/0078980 | A1 * | 3/2013 | Saito | H04W 76/30 455/418 |

(Continued)

FOREIGN PATENT DOCUMENTS

| | | |
|---|---|---|
| JP | 03-252799 | 11/1991 |
| JP | 2000-504859 | 4/2000 |

(Continued)

*Primary Examiner* — Marthe Y Marc-Coleman
(74) *Attorney, Agent, or Firm* — Oblon, McClelland, Maier & Neustadt, L.L.P.

(57) ABSTRACT

According to one embodiment, generally, an information processing apparatus includes a vehicle detector, a stopped-vehicle evaluator, a parked-vehicle evaluator, and a determiner. The vehicle detector detects a vehicle from a captured image by an imaging device mounted in a probe vehicle. The stopped-vehicle evaluator calculates a stopped-vehicle evaluation value based on one or more stopped-vehicle conditions. The parked-vehicle evaluator calculates a parked-vehicle evaluation value based on one or more parked-vehicle conditions. The determiner determines whether the vehicle is stopped or parked based on both the evaluation values.

13 Claims, 14 Drawing Sheets

(56) References Cited

U.S. PATENT DOCUMENTS

| | | | | |
|---|---|---|---|---|
| 2016/0253902 | A1 | 9/2016 | Yokoi et al. | |
| 2018/0247527 | A1 | 8/2018 | Biehle et al. | |
| 2018/0286220 | A1* | 10/2018 | Fowe | B60W 30/0953 |

FOREIGN PATENT DOCUMENTS

| | | | |
|---|---|---|---|
| JP | 2005-202678 | A | 7/2005 |
| JP | 2009-169527 | | 7/2009 |
| JP | 2015-076074 | | 4/2015 |
| JP | 2016-062443 | | 4/2016 |
| JP | 2016-170708 | | 9/2016 |
| JP | 2017-045211 | | 3/2017 |
| WO | WO 2016/198498 | A1 | 12/2016 |
| WO | WO 2017/045779 | A1 | 3/2017 |

* cited by examiner

FIG.7

852

| DETERMINATION RESULT | PROBE VEHICLE ID | CAPTURE D IMAGE | IMAGING POSITION | IMAGING TIME | SATISFIED CONDITION ID BY VEHICLE | INTER-VEHICLE DISTANCE | DEPTH MAP |
|---|---|---|---|---|---|---|---|
| PARKED VEHICLE | A1 | xxxx1 | LATITUDE a1, LONGITUDE b1 | 2017/4/1 10:00 | 053, 054, 101, 104, 151 | d1m | yyyyy1 |
| STOPPED VEHICLE | A1 | xxxx2 | LATITUDE a2, LONGITUDE b2 | 2017/4/1 10:10 | 001, 002, 003, 053, 054, 152 | d2m | yyyyy2 |
| UNKNOWN | A2 | xxxx3 | LATITUDE a3, LONGITUDE b3 | 2017/4/1 10:15 | 003, 151, 152 | d3m | yyyyy3 |
| ... | ... | ... | ... | ... | ... | ... | ... |

FIG.9

| CLASS | CONDITION ID | CONDITION | POINT |
|---|---|---|---|
| STOPPED VEHICLE | 001 | INTER-VEHICLE DISTANCE CONCERNED IS EQUAL TO OR SMALLER THAN THRESHOLD OF INTER-VEHICLE DISTANCE BETWEEN STOPPED VEHICLES | 5 |
| | 002 | BRAKE LAMPS OR TAIL LAMPS OF VEHICLE ARE ON | 5 |
| | 003 | VEHICLE IS LOCATED NEAR CENTER OF LANE | 7 |
| | 004 | TRAFFIC LIGHT IS DETECTED AHEAD OF VEHICLE | 3 |
| | 005 | MOTION OF STOPPED VEHICLE IS DETECTED | 10 |
| | 051 | IMAGING POSITION IS NEAR TRAFFIC LIGHT OR RAILROAD CROSSING IN TRAVELLING DIRECTION OF PROBE VEHICLE | 3 |
| | 052 | RATIO AT WHICH VEHICLES DETECTED AT SAME IMAGING POSITION ARE FOUND AS STOPPED VEHICLES IN PAST HISTORY MATCHES OR EXCEEDS THRESHOLD | 3 |
| | 053 | IMAGING POSITION IS NEAR BUS STOP | 3 |
| | 054 | IMAGING POSITION IS AWAY FROM PARKING METER | 3 |
| PARKED VEHICLE | 101 | INTER-VEHICLE DISTANCE CONCERNED IS EQUAL TO OR LARGER THAN THRESHOLD OF INTER-VEHICLE DISTANCE BETWEEN PARKED VEHICLES | 5 |
| | 102 | HAZARD LAMPS OF VEHICLE ARE FLASHING | 5 |
| | 103 | IMAGING TIME IS DURING NIGHT-TIME, AND BRAKE LAMPS AND TAIL LAMPS ARE OFF | 5 |
| | 104 | VEHICLE IS LOCATED CLOSER TO SHOULDER OF LANE | 4 |
| | 151 | IMAGING POSITION IS AWAY FROM TRAFFIC LIGHT AND RAILROAD CROSSING | 3 |
| | 152 | IMAGING POSITION IS AWAY FROM BUS STOP | 3 |
| | 153 | LEVEL OF SHAPE MATCH BETWEEN DETECTED VEHICLE AND VEHICLE CAPTURED BY ANOTHER PROBE VEHICLE AT SAME IMAGING POSITION IS EQUAL TO OR HIGHER THAN THRESHOLD | 7 |
| | 154 | IMAGING POSITION IS NEAR PARKING METER | 5 |
| | 155 | RATIO AT WHICH VEHICLES DETECTED AT SAME IMAGING POSITION ARE FOUND AS PARKED VEHICLES IN PAST HISTORY MATCHES OR EXCEEDS THRESHOLD | 3 |
| | 156 | LEVEL OF MATCH BETWEEN DETECTED VEHICLE-LINE PATTERN AND VEHICLE-LINE PATTERN DETECTED FROM CAPTURED IMAGE BY ANOTHER PROBE VEHICLE AT SAME IMAGING POSITION IS EQUAL TO OR HIGHER THAN THRESHOLD | 5 |

INFORMATION PROCESSING APPARATUS, INFORMATION PROCESS SYSTEM, AND INFORMATION PROCESS METHOD

CROSS-REFERENCE TO RELATED APPLICATIONS

This application is based upon and claims the benefit of priority from Japanese Patent Application No. 2017-121950, filed Jun. 22, 2017, the entire contents of which are incorporated herein by reference.

FIELD

Embodiments described herein relate generally to an information processing apparatus, an information processing system, and an information processing method.

BACKGROUND

Conventionally, information analysis techniques are available for analyzing information acquired by a probe vehicle to understand traffic conditions such as road traffic congestion or find vehicles parked on roads or streets. One of such techniques is for detecting not-running vehicles among the vehicles found on the road, from a captured image of the surroundings by an imaging device mounted on a probe vehicle.

However, such conventional techniques have difficulties in accurately determining whether the not-running vehicle is parked or temporarily stopped e.g., to wait for a traffic light to change.

BRIEF DESCRIPTION OF THE DRAWINGS

FIG. 7 is a schematic illustrating an example of a history database containing information in table format in the first embodiment;

FIG. 9 is a schematic of an exemplary list of conditions in the first embodiment;

DETAILED DESCRIPTION

According to one embodiment, generally, an information processing apparatus includes a vehicle detector, a running determiner, a stopped-vehicle evaluator, a parked-vehicle evaluator, and a determiner. The vehicle detector detects a vehicle from a captured image by an imaging device that is mounted in a probe vehicle. The running determiner determines whether the detected vehicle is running. The stopped-vehicle evaluator calculates, when the vehicle is not running, a stopped-vehicle evaluation value indicating a possibility of the vehicle being a stopped vehicle, based on one or more stopped-vehicle conditions defining characteristics of a stopped vehicle that remains at a stop for a given length of time being less than a given threshold. The parked-vehicle evaluator calculates, when the vehicle is not running, a parked-vehicle evaluation value indicating a possibility of the vehicle being a parked vehicle, based on one or more parked-vehicle conditions defining characteristics of a parked vehicle that remains at a stop for a given length of time being equal to or more than the threshold. The determiner determines whether the vehicle is a stopped vehicle or a parked vehicle, based on the stopped-vehicle evaluation value and the parked-vehicle evaluation value.

First Embodiment

In an information processing system according to a first embodiment, a management device receives a captured image from a probe vehicle and determines whether a vehicle in the captured image is a stopping vehicle, a parked vehicle, or a status-unknown vehicle that is a vehicle which cannot be determined as stopped or parked. Hereinafter, the first embodiment will be explained in detail.

Figure 1:
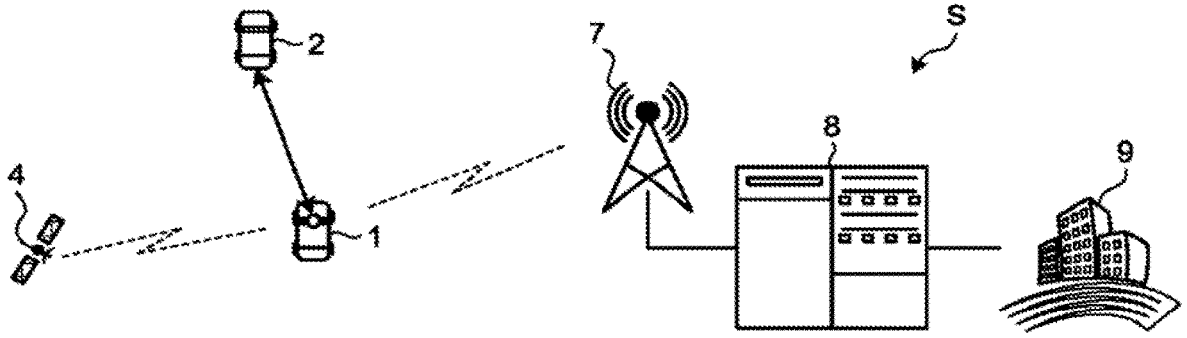
FIG. 1 is a schematic illustrating an example of the overall configuration of an information processing system according to a first embodiment.

FIG. 1 is a schematic illustrating an example of the overall configuration of an information processing system S according to the first embodiment. As illustrated in FIG. 1, the information processing system S includes a probe vehicle 1 and a management device 8.

The probe vehicle 1 incorporates an imaging device and a global positioning system (GPS) antenna. The probe vehicle 1 transmits captured images and information such as the position of the probe vehicle 1 to the management device 8 while running on the road. The probe vehicle 1 captures an image of a vehicle 2, for example. Although only one probe vehicle 1 is illustrated in FIG. 1, the information processing system S is assumed to include two or more probe vehicles 1.

The vehicle 2 is a vehicle ahead of the probe vehicle 1 in another lane (hereinafter, referred to as an adjacent lane) adjacent to the lane in which the probe vehicle 1 is located (hereinafter, referred to as an ego lane). The probe vehicle 1 may also capture an image of a vehicle behind or beside of the probe vehicle 1, or capture other vehicles in the ego lane.

The management device 8 receives, from the probe vehicle 1, the captured image including the vehicle 2 and information such as the position of the probe vehicle 1 based on the GPS signal. When finding the vehicle 2 as not running, the management device 8 determines whether the vehicle 2 is a stopped vehicle, a parked vehicle, or a status-unknown vehicle, based on the information received from the probe vehicle 1 and conditions as described later. Method of the determination will be described later in detail. The management device 8 is an example of an information processing apparatus according to the embodiment.

The parked vehicle is a vehicle which remains at a stop for a certain length of time being a given threshold or above. The stopped vehicle is a vehicle which remains at a stop for a certain length of time being below the threshold. The stopped vehicle includes, for example, a vehicle that is temporarily at a stop, waiting for a traffic light to change or due to traffic congestion. The threshold of the stoppage time in the embodiment is set to 5 minutes as an example, but is not limited thereto. The stopped vehicle may be referred to as a temporarily stopped vehicle, a vehicle waiting for a traffic light to change, or a vehicle in traffic congestion, for example. By the later-described method, the management device 8 according to the embodiment accurately determines whether a not-running vehicle is a stopped vehicle or a parked vehicle, without measuring the stoppage time of the vehicle to determine the time as being the threshold or above.

The management device 8 also transmits data including a result of the determination on the vehicle 2, the position of the vehicle 2, the time at which the image is captured, and the captured image to a traffic information provider 9 via a network.

A GPS satellite 4 illustrated in FIG. 1 transmits GPS signals to the probe vehicle 1.

A base station 7 illustrated in FIG. 1 transmits and receives information wirelessly. The probe vehicle 1 and the management device 8 can transmit and receive information via the base station 7 using wireless communication.

The traffic information provider 9 illustrated in FIG. 1 provides traffic information including road traffic congestions or presence or absence of parked vehicles to drivers or companies. The traffic information provider 9 receives information about detected stopped vehicles and parked vehicles from the management device 8.

Figure 2:
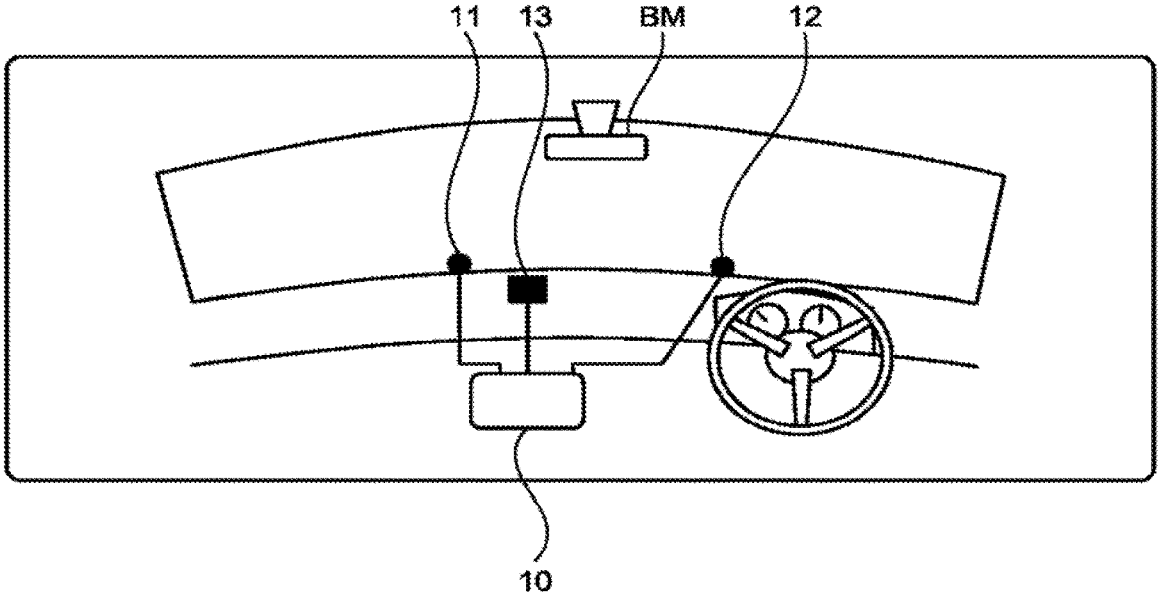
FIG. 2 is a schematic illustrating an example of a configuration around a cockpit (driver's seat) of a probe vehicle in the first embodiment.

FIG. 2 is a schematic illustrating an example of a configuration around a cockpit (driver's seat) in the probe vehicle 1 in the embodiment. As illustrated in FIG. 2, the probe vehicle 1 includes a control device 10, a first imaging device 11, a second imaging device 12, and a GPS antenna 13.

The control device 10 controls the probe vehicle 1 as a whole. The control device 10 is an example of an onboard device according to the embodiment.

The first imaging device 11 is provided on the left side of the driver's seat, as viewed from a rearview mirror BM of the probe vehicle 1. The second imaging device 12 is provided on the right side of the driver's seat, as viewed from the rearview mirror BM of the probe vehicle 1. The first imaging device 11 and the second imaging device 12 capture the vehicle 2 ahead of the probe vehicle 1 at different angles. The first imaging device 11 and the second imaging device 12 form a stereo camera.

With no need to distinguish between the first imaging device 11 and the second imaging device 12, the first imaging device 11 and the second imaging device 12 are collectively referred to as an imaging device. The imaging device according to the embodiment is positioned to capture ahead of the probe vehicle 1, but the position of the imaging device is not limited thereto. For example, the imaging device may also be positioned to capture diagonally ahead, the right or the left side, diagonally behind, or behind of the probe vehicle 1. The imaging device may be an omni-directional camera capable of capturing a 360-degree view around the camera. The number of imaging devices to mount is not limited to two. In the embodiment, the imaging device captures moving images but may capture still images. The imaging device is not limited to a stereo camera, and may be a monocular camera.

The GPS antenna 13 receives the GPS signals transmitted from the GPS satellite 4.

Figure 3:
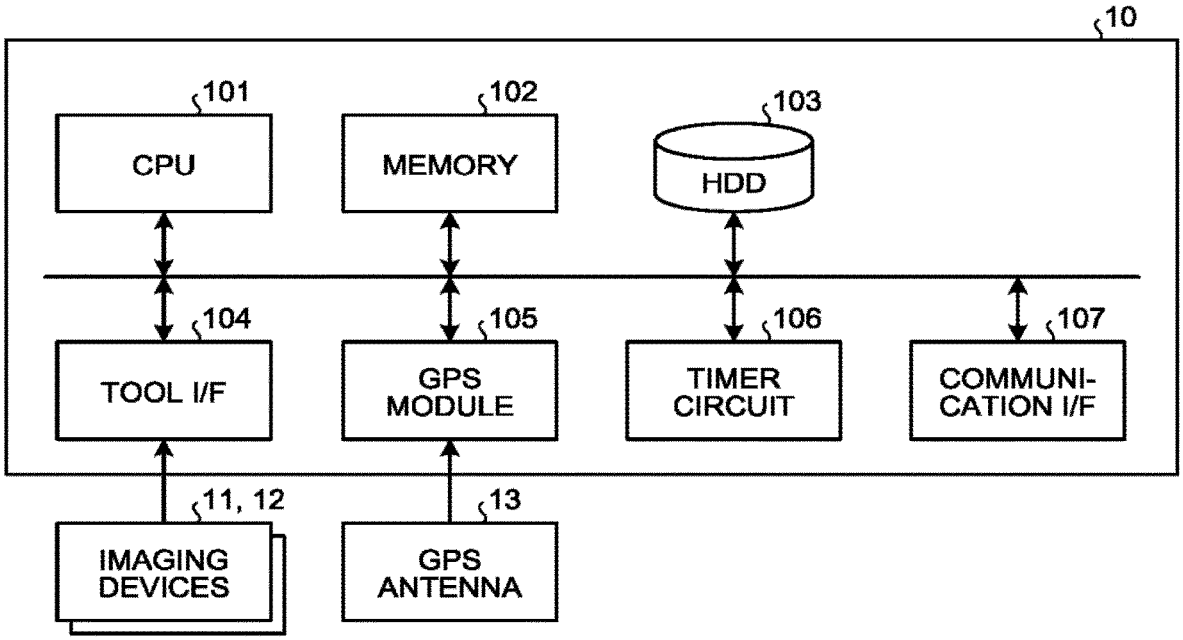
FIG. 3 is a schematic illustrating an example of a hardware configuration of a control device of the probe vehicle in the first embodiment.

FIG. 3 is a schematic illustrating an example of a hardware configuration of the control device 10 of the probe vehicle 1 in the embodiment. As illustrated in FIG. 3, the control device 10 includes a central processing unit (CPU) 101, a memory 102, a hard disk drive (HDD) 103, a tool interface (I/F) 104, a GPS module 105, a timer circuit 106, and a communication interface (I/F) 107.

The CPU 101 controls the control device 10 as a whole. The memory 102 stores various types of data such as computer programs, and examples of the memory 102 include a read-only memory (ROM). The memory 102 may include an additional random-access memory (RAM) to serve as a work area of the CPU 101, for example, or the RAM may be provided separately from the memory 102. The HDD 103 is an external storage device (auxiliary memory). The control device 10 may include a storage medium such as a flash memory, instead of the HDD 103.

The tool interface 104 is an interface for connecting to various tools of the probe vehicle 1. Examples of the tools include the imaging device, an engine control unit (ECU) for the probe vehicle 1, various sensors such as a wheel speed sensor, a car navigation system, and a smartphone. The tool interface 104 is connected to the imaging device, for example, and receives captured images.

The GPS module 105 receives GPS signals via the GPS antenna 13. The GPS module 105 also calculates the current position (latitude and longitude) of the probe vehicle 1, based on the GPS signals (radio waves) received from multiple satellites 4. The GPS module 105 may also calculate the current time based on the GPS signals received from the GPS satellites 4.

The timer circuit 106 has a function for measuring time. The timer circuit 106 is, for example, a real-time clock (RTC), but not limited thereto.

The communication interface 107 is an interface for transmitting and receiving information via a network, for example. The communication interface 107 is connected to the base station 7 via a wireless network, and transmits and receives information to and from the management device 8. For example, the communication interface 107 may transmit and receive information over Wi-Fi (registered trademark) or Bluetooth (registered trademark), using a network connection of a mobile router or a smartphone.

Figure 4:
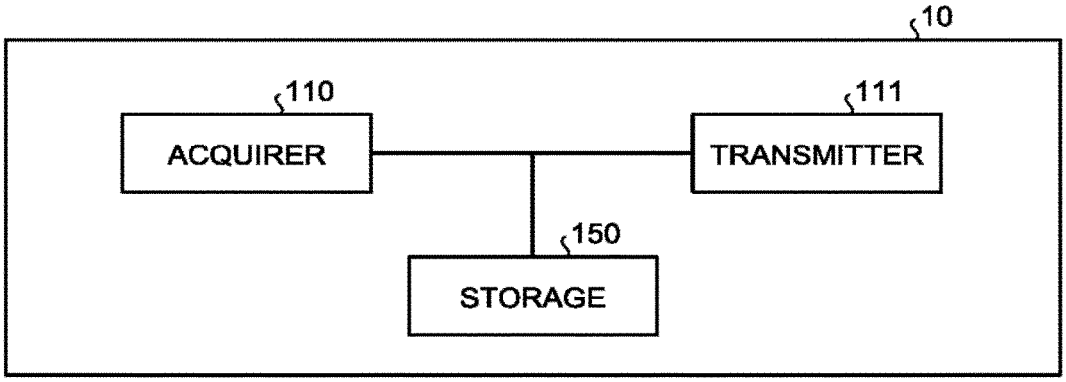
FIG. 4 is a block diagram illustrating an example of functions of the control device of the probe vehicle in the first embodiment.

FIG. 4 is a block diagram illustrating an example of functions of the control device 10 of the probe vehicle 1 in the embodiment. As illustrated in FIG. 4, the control device 10 includes an acquirer 110, a transmitter ill, and a storage 150.

The storage 150 stores a probe vehicle ID for identifying the probe vehicle 1 incorporating the control device 10. The probe vehicle ID may be any identification information to identify the probe vehicle 1. The storage 150 includes the HDD 103, for example.

The acquirer 110 acquires various types of information via the tool interface 104. Specifically, the acquirer 110 acquires captured images from the imaging device via the tool interface 104. For example, the acquirer 110 acquires captured images from the imaging device with given time intervals. The acquirer 110 acquires a video including two or more frames as the captured image at once. Alternatively, the acquirer 110 may acquire a one-frame still image at once.

The acquirer 110 also acquires the speed of the probe vehicle 1 when the image is captured, from the ECU via the tool interface 104. The acquirer 110 may also acquire a wheel speed from the wheel speed sensor of the probe vehicle 1 via the tool interface 104 to calculate the speed of the probe vehicle 1. Alternatively, the acquirer 110 may calculate the speed of the probe vehicle 1 according to a change in the position of the probe vehicle 1 in unit of time, calculated by the GPS module 105.

The acquirer 110 also acquires the current time from the timer circuit 106. The acquirer 110 acquires the current time concurrently with acquiring the captured image from the imaging device, in other words, the current time represents the time at which the image is captured (imaging time). The manner of current-time acquisition is not limited thereto, and the acquirer 110 may acquire the current time from the GPS module 105, a car navigation system, or a smartphone, for example.

The acquirer 110 also acquires the position (latitude and longitude) of the probe vehicle 1 at the current time from the GPS module 105. In the embodiment, the acquirer 110 acquires the position of the probe vehicle 1 concurrently with acquiring the image from the imaging device, that is, the position represents the position of the probe vehicle 1 at the imaging time (imaging position).

The transmitter 111 transmits the captured image, the imaging position, the imaging time, and the speed of the probe vehicle 1 acquired by the acquirer 110, and the probe vehicle ID of the probe vehicle 1 stored in the storage 150 to the management device 8, in association with one another.

The management device 8 will now be explained in detail.

Figure 5:
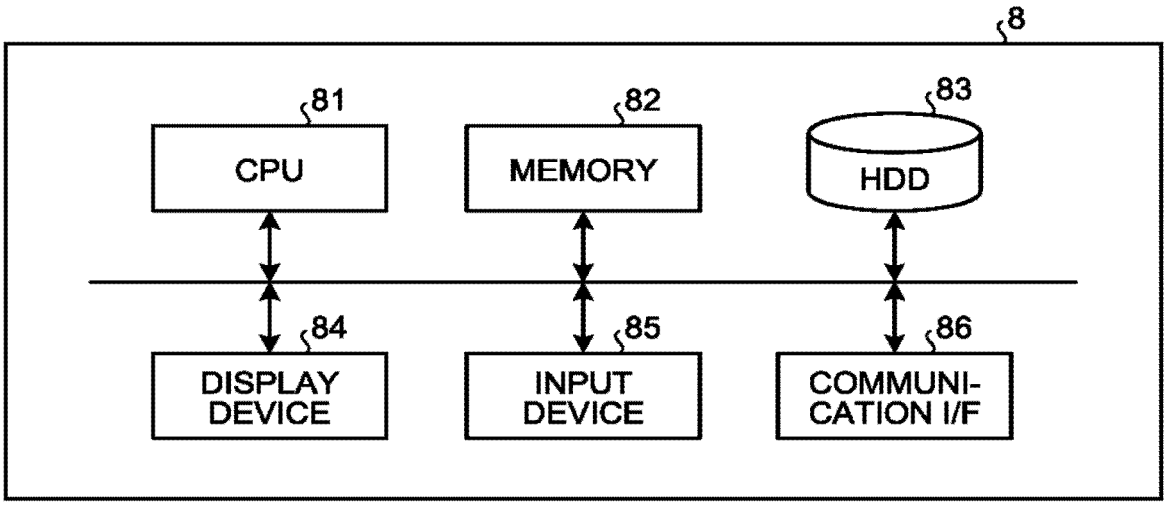
FIG. 5 is a schematic illustrating an example of a hardware configuration of a management device in the first embodiment.

FIG. 5 is a schematic illustrating an example of a hardware configuration of the management device 8 in the embodiment. As illustrated in FIG. 5, the management device 8 includes a CPU 81, a memory 82, an HDD 83, a display device 84, an input device 85, a communication I/F 86, and has a hardware configuration of a general computer. The CPU 81 loads a computer program from the HDD 83 (external storage device) onto the memory 82, for example.

The display device 84 includes a liquid crystal panel, for example. The input device 85 is a keyboard, a mouse, and a touch panel, for example, and receives user operations. The display device 84 and the input device 85 may be removable.

The communication I/F 86 is an interface for allowing the management device 8 to transmit and receive information over a network, for example.

Figure 6:
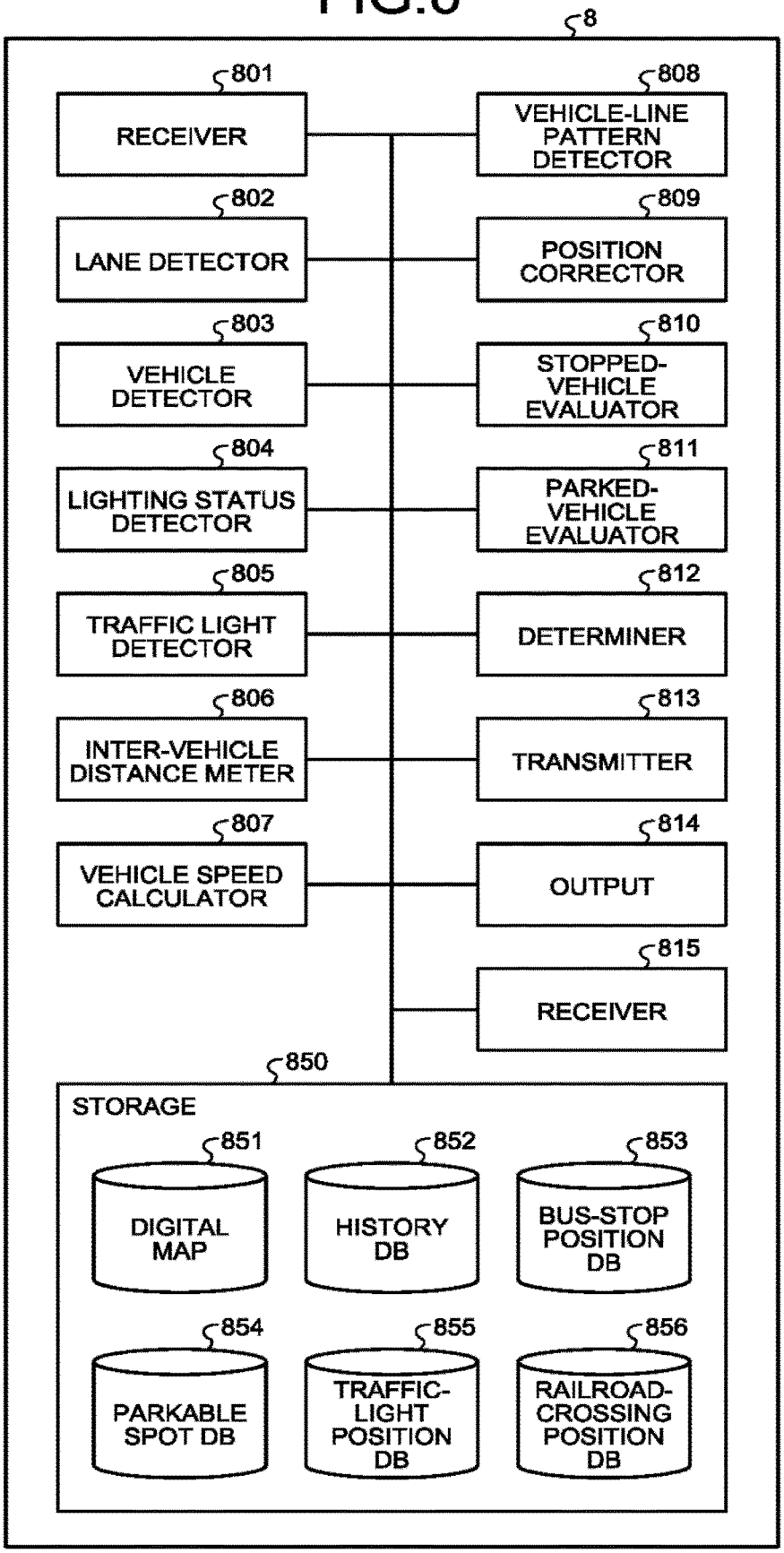
FIG. 6 is a block diagram illustrating an example of functions of the management device in the first embodiment.

FIG. 6 is a block diagram illustrating an example of functions of the management device 8 in the embodiment. As illustrated in FIG. 6, the management device 8 includes a receiver 801, a lane detector 802, a vehicle detector 803, a lighting status detector 804, a traffic light detector 805, an inter-vehicle distance meter 806, a vehicle speed calculator 807, a vehicle-line pattern detector 808, a position corrector 809, a stopped-vehicle evaluator 810, a parked-vehicle evaluator 811, a determiner 812, a transmitter 813, an output 814, a receiver 815, and a storage 850.

The storage 850 stores a digital map 851, a history database (DB) 852, a bus-stop position DB 853, a parkable spot database (DB) 854, a traffic-light position database (DB) 855, and a railroad-crossing position database (DB) 856.

The digital map 851 is digitalized map information. The digital map 851 includes information for identifying road positions (latitude and longitude) on which vehicles can travel.

The history database 852 records the history of previous determinations by the determiner 812, which is described later.

FIG. 7 is a schematic illustrating an example of the history database 852 containing information in table format in the embodiment. As illustrated in FIG. 7, the history database 852 includes results of determination, probe vehicle IDs, captured images, imaging positions, imaging time, and IDs of conditions satisfied by the vehicles, inter-vehicle distances, and depth maps, in association with one another.

The results of determination are information representing results of the determination by the determiner 812 whether the vehicle 2 is a stopped vehicle, a parked vehicle, or a status-unknown (stopped or parked) vehicle.

The imaging positions are information representing the imaging positions (latitude and longitude) corrected by the position corrector 809, which is described later. The condition IDs satisfied by the vehicles are the ones determined by the stopped-vehicle evaluator 810 or the parked-vehicle evaluator 811, which are described later. The conditions will be described later in detail.

The inter-vehicle distances are the distances between the vehicle 2 and another vehicle ahead of the vehicle 2. The inter-vehicle distance will be described later in connection with the inter-vehicle distance meter 806.

The depth maps are images having depth information of a subject, generated from captured images by the vehicle-line pattern detector 808, which is described later. The depth maps will be described later in connection with the vehicle-line pattern detector 808.

The configuration of the history database 852 and the data registered therein in FIG. 7 are merely exemplary, and the embodiment is not limited thereto.

Referring back to FIG. 6, the bus-stop position database 853 is a database in which bus-stop positions (latitude and longitude) are registered.

The parkable spot database 854 is a database in which parkable positions on streets or roads are registered. For example, parking-meter positions are registered in the parkable spot database 854.

The traffic-light position database 855 is a database in which positions (latitude and longitude) of traffic lights are registered. The railroad-crossing position database 856 is a database in which positions (latitude and longitude) of railroad crossings are registered.

The receiver 801 receives a captured image, an imaging position, imaging time, a speed of the probe vehicle 1, and a probe vehicle ID from the control device 10.

The lane detector 802 performs image processing to the frames of the captured image received by the receiver 801 to detect a lane or lanes from the frames. For example, the lane detector 802 detects two or more white lines by edge detection of a lane or lanes between white lines. The objects to detect are not limited to white lines, and may be guard rails or curbs, for example. The lane-detection method is not limited thereto, and any other methods including pattern recognition may be used. The lane detector 802 also distinguishes, from the detected lanes, the lane of the probe vehicle 1 (hereinafter, referred to as an ego lane) and another lane adjacent to the ego lane (hereinafter, referred to as an adjacent lane).

The vehicle detector 803 detects the vehicle 2 in the adjacent lane from the captured image received by the receiver 801. Specifically, the vehicle detector 803 performs image processing including pattern recognition to the frames of the captured image received by the receiver 801, to detect the vehicle 2 from the frames. The vehicle detection method is not limited thereto, and any other methods may be used. The vehicle detector 803 also determines from the positions of the detected vehicle 2 and the lanes detected by the lane detector 802 in the captured image whether the detected vehicle 2 is in the adjacent lane.

The vehicle detector 803 detects, from the captured image, other vehicles ahead of the running vehicle 2 in the same lane (the adjacent lane).

The vehicle detector 803 also determines the position of the vehicle 2 along the width (horizontal direction) of the adjacent lane. For example, the vehicle detector 803 determines the position of the vehicle 2 by calculating a distance between the shoulder of the adjacent lane and the vehicle 2, and a distance between the opposite end of the adjacent lane relative to the shoulder and the vehicle 2. The shoulder of the adjacent lane is defined to be on the left side of the probe vehicle 1 in the left-hand traffic. The position determination on the vehicle 2 in the width direction of the adjacent lane is, however, not limited thereto. For example, the vehicle detector 803 may detect the midpoint of the width of the adjacent lane as the center of the adjacent lane, and calculate a distance between the width center of the body of the vehicle 2 and the center of the adjacent lane.

In the embodiment, the vehicle detector 803 detects the vehicle 2 in the adjacent lane, but the vehicles to detect are not limited thereto. For example, when the probe vehicle is running on a single-lane road, the vehicle detector 803 may detect the vehicle 2 in the ego lane. When the probe vehicle is running on a road with three or more lanes, the vehicle detector 803 may detect the vehicle 2 in a lane other than the ego lane and the adjacent lane.

The lighting status detector 804 detects the on/off state of the lighting of the vehicle 2 from the captured image received by the receiver 801. Examples of the lighting of the vehicle 2 include brake lamps, tail lamps, and hazard lamps. The on/off status refers to one of lighting-up, lighting-off, and flashing of the lighting.

Specifically, the lighting status detector 804 detects from the captured image a light source that emits light from the vehicle 2 detected by the vehicle detector 803 to the imaging device, as the lighting of the vehicle 2. The lighting status detector 804 then determines which type of the lighting (brake lamps, tail lamps, or hazard lamps) of the vehicle 2 the light source is, based on the position of the detected light source on the vehicle 2. The lighting status detector 804 determines that the brake lamps are lit, upon determining that the detected light source are brake lamps. Upon determining the detected light source as tail lamps, The lighting status detector 804 determines that the tail lamps are lit. The lighting status detector 804 detects a light source from the frames of the captured image, and determines that the hazard lamps are flashing, upon detecting repetitive turning-on and -off of the hazard lamps for a certain length of time or longer. With no detection of the light source of the vehicle 2 from the captured image or being unable to determine, the lighting status detector 804 determines that none of the lamps are lit. When being unable to determine which of the lamps are the detected light source or unable to detect a light source due to backlight of sunlight or the like, the lighting status detector 804 determines that the on/off status is unknown.

The lighting status detection of the lighting status detector 804 is not limited thereto. The lighting status detector 804 may also be configured to detect the on/off state of the lighting of the vehicle 2 only when the imaging time of the captured image is during the night.

The traffic light detector 805 detects a traffic light ahead of (in the travelling direction of) the detected vehicle 2 by the vehicle detector 803 from the captured image received by the receiver 801 by, for example, pattern recognition. The traffic light detector 805 may be configured to further determine whether the detected traffic light displays red. For example, the traffic light detector 805 identifies the lit color of the traffic light in the captured image to determine whether the traffic light displays red. The traffic light detector 805 may also detect, for example, a crossing gate at a railroad crossing or a bus stop from the captured image.

The inter-vehicle distance meter 806 measures an inter-vehicle distance between the probe vehicle 1 and the vehicle 2, an inter-vehicle distance between the probe vehicle 1 and another vehicle ahead of the vehicle 2, and an inter-vehicle distance between the vehicle 2 and another vehicle ahead of the vehicle 2 from each of the frames of the captured image.

Figure 8:
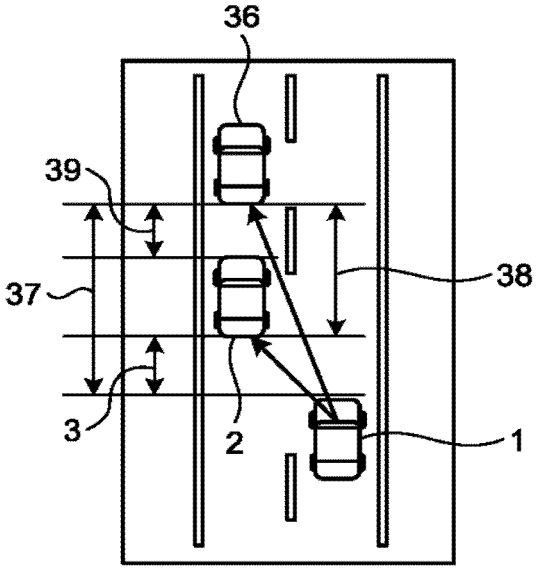
FIG. 8 is a schematic for explaining an inter-vehicle distance measurement in the first embodiment.

FIG. 8 is a schematic for explaining inter-vehicle distance measurement in the embodiment. The inter-vehicle distance meter 806 measures an inter-vehicle distance 3 between the probe vehicle 1 and the vehicle 2, and an inter-vehicle distance 37 between the probe vehicle 1 and another vehicle 36, as illustrated in FIG. 8, based on the parallax between the captured images by the first imaging device 11 and the second imaging device 12. The inter-vehicle distance meter 806 then subtracts the inter-vehicle distance 3 from the inter-vehicle distance 37 to calculate a distance 38 between the rear end of another vehicle 36 and the rear end of the vehicle 2. The inter-vehicle distance meter 806 then calculates an inter-vehicle distance 39 between the vehicle 2 and another vehicle 36 by subtracting a typical vehicle-length from the distance 38.

The measurement of the inter-vehicle distance 39 between the vehicle 2 and another vehicle 36 is not limited thereto. For example, the inter-vehicle distance meter 806 may directly measure the inter-vehicle distance 39 between the vehicle 2 and another vehicle 36 by measuring the depth of a subject in the captured images by the imaging devices based on the parallax between the captured images.

Referring back to FIG. 6, the vehicle speed calculator 807 calculates the speed of the vehicle 2. Specifically, the vehicle speed calculator 807 acquires the amount of change in the inter-vehicle distance 3 between the probe vehicle 1 and the vehicle 2 measured by the inter-vehicle distance meter 806 in a certain length of time, from the inter-vehicle distance 3 in each of the frames. The vehicle speed calculator 807 then calculates a relative speed of the vehicle 2 to the speed of the probe vehicle 1 from the amount of change in the inter-vehicle distance 3 in the certain length of time. The vehicle speed calculator 807 then calculates the absolute speed of the vehicle 2 as a vehicle speed from the speed of the probe vehicle 1 received by the receiver 801 and the relative speed of the vehicle 2 to the speed of the probe vehicle 1.

In the embodiment, when the speed of the vehicle 2 is 0 kilometers per hour, the vehicle speed calculator 807 determines that the vehicle 2 is not running (at a stop). If the speed of the vehicle 2 is not 0 kilometers per hour, the vehicle speed calculator 807 determines that the vehicle 2 is running (not at a stop). The vehicle speed calculator 807 is an exemplary running determiner according to the embodiment. The speed used as a reference for this determination is not limited to 0 kilometers per hour. The vehicle speed calculator 807 may also determine that the vehicle 2 is not running when the vehicle speed is lower than a given threshold. The determination on whether the vehicle 2 is running is not limited to this example. For example, the vehicle speed calculator 807 may determine whether the vehicle 2 is running depending on change or no change in the position of the vehicle 2 with respect to the background in the captured image.

The vehicle-line pattern detector 808 generates a depth map of the image area near the vehicle 2 from the captured image received by the receiver 801 to detect a pattern of lined-up vehicles. In the embodiment, the vehicle-line pattern represents the shape of the overall vehicle line including the vehicle 2. Specifically, the vehicle-line pattern detector 808 measures the depth (distance) of a subject in the captured image based on the parallax between the captured image by the first imaging device 11 and the captured image by the second imaging device 12. The vehicle-line pattern detector 808 generates a depth map based on the measured depth (distance). For example, the depth map may be a monochromatic image representing the distance by colors, e.g., such that the closer to the subject, the lighter the color, and the further from the subject, the darker the color.

The vehicle-line pattern detector 808 detects, as a vehicle-line pattern, a given image area including the vehicle 2 detected by the vehicle detector 803 in the depth map generated from the captured image. The given image area is a pre-defined area assumingly including a vehicle-line of the vehicle 2. Alternatively, the vehicle-line pattern detector 808 may handle the entire depth map as the vehicle-line pattern. The vehicle-line pattern detection is not limited thereto, and any approach other than the depth map may also be used.

The vehicle-line pattern detector 808 generates a depth map when the vehicle speed calculator 807 determines that the vehicle 2 is not running. Such a limitation can reduce the processing load on the vehicle-line pattern detector 808.

When the vehicle speed calculator 807 determines that the vehicle 2 is not running, the position corrector 809 corrects the imaging position received by the receiver 801 to a position on the road, using the digital map 851. The imaging position received by the receiver 801 may be offset from the road where the probe vehicle 1 is running due to some error in the imaging position based on the GPS signal. The position corrector 809 corrects the imaging position received by the receiver 801 to a position (latitude and longitude) on the road on the basis of road-position identifying information contained in the digital map 851.

The position corrector 809 identifies the position (latitude and longitude) of the vehicle 2 based on the corrected imaging position and on the inter-vehicle distance 37 between the probe vehicle 1 and another vehicle 36 measured by the inter-vehicle distance meter 806.

When the vehicle 2 is not running, the stopped-vehicle evaluator 810 calculates a stopped-vehicle evaluation value indicating the possibility of the vehicle 2 being a stopped vehicle, based on one or more stopped-vehicle conditions representing characteristics of a stopped vehicle that remains at a stop for a certain length of time being less than a given threshold.

FIG. 9 is a schematic of an exemplary list of conditions in the embodiment. In FIG. 9 the class "stopped vehicle" lists stopped-vehicle conditions. The class "parked vehicle" lists parked-vehicle conditions. The stopped-vehicle conditions are conditions for determining the vehicle 2 as a stopped vehicle. The parked-vehicle conditions are conditions for determining the vehicle 2 as a parked vehicle. Hereinafter, without the need to distinguish between the stopped-vehicle conditions and the parked-vehicle conditions, both of them are simply referred to as conditions. The parked-vehicle conditions will be described later in connection with the parked-vehicle evaluator 811.

As illustrated in FIG. 9, the stopped-vehicle conditions are mutually different, and the parked-vehicle conditions are mutually different. The condition IDs are numbers for identifying the respective conditions.

Each of the conditions is associated with a point as illustrated in FIG. 9. As illustrated in FIG. 9, the points associated with the conditions are different values depending on the importance (contribution to determination) of the conditions). In the embodiment, the higher the importance of the conditions, the larger the values assigned to the points. The reference for determining the values of the points is not limited thereto. Alternatively, the reference can be such that the higher the importance of the conditions, the smaller the values assigned to the points. In the embodiment, the values of the points associated with the conditions are pre-defined. For example, the condition IDs and the values of the points may be stored in the storage 850, in association with each other.

Specifically, the stopped-vehicle evaluator 810 determines whether the vehicle 2 satisfies each of the stopped-vehicle conditions. In other words, the stopped-vehicle evaluator 810 determines whether the vehicle 2 shows the characteristics of a stopped vehicle. The stopped-vehicle evaluator 810 calculates a stopped-vehicle evaluation value by adding (summing up) the points assigned to the stopped-vehicle conditions satisfied by the vehicle 2. The stopped-vehicle evaluation value represents the possibility of the vehicle 2 being a stopped-vehicle. The stopped-vehicle evaluation value is also a value indicating the likeliness of the vehicle being a stopped vehicle.

As illustrated in FIG. 9, the stopped-vehicle conditions include one that the inter-vehicle distance concerned is equal to or smaller than a threshold of a distance between stopped vehicles (condition ID "001"). Specifically, the stopped-vehicle evaluator 810 determines whether the inter-vehicle distance 39 between the vehicle 2 and another vehicle 36 measured by the inter-vehicle distance meter 806 is equal to or shorter than a threshold of the distance between stopped vehicles. The threshold of the inter-vehicle distance between stopped vehicles in the condition concerned is an example of a third threshold according to the embodiment.

Figure 10:
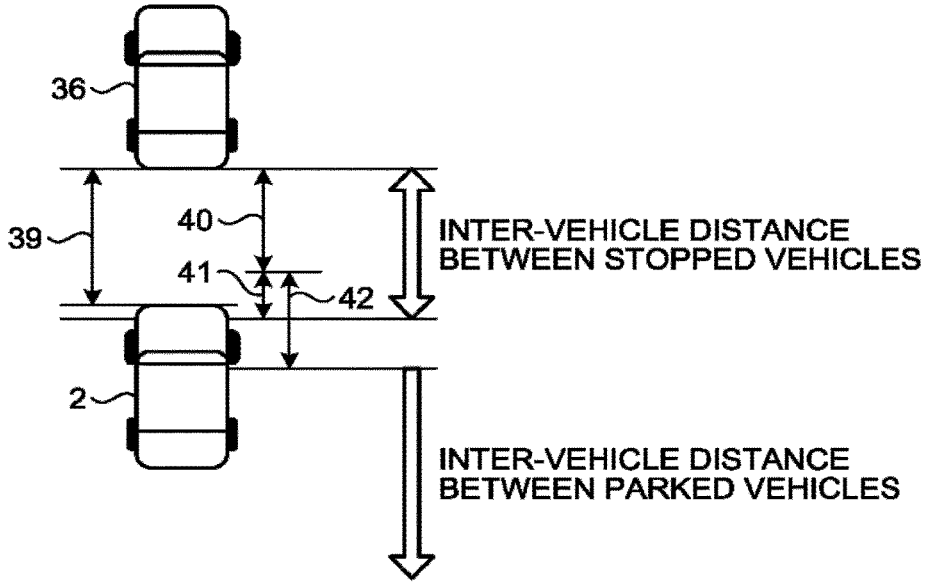
FIG. 10 is a schematic illustrating exemplary thresholds of the inter-vehicle distance in the first embodiment.

FIG. 10 is a schematic illustrating exemplary thresholds of the inter-vehicle distance in the embodiment. An average stopped-vehicle distance 40 illustrated in FIG. 10 is a typical inter-vehicle distance between stopped vehicles waiting for the traffic light to change, and represents an average of the measurements of inter-vehicle distances between stopped vehicles, for example. A stopped-vehicle distance margin 41 is a margin of the average stopped-vehicle distance 40, and indicates a tolerance of increase from the average stopped-vehicle distance 40. The threshold of the inter-vehicle distance between the stopped vehicles in the embodiment is equal to the sum of the average stopped-vehicle distance 40 and the stopped-vehicle distance margin 41. The stopped-vehicle evaluator 810 determines that the vehicle 2 satisfies the condition in question when the inter-vehicle distance 39 between the vehicle 2 and another vehicle 36 is equal to or shorter than the threshold of the inter-vehicle distance between the stopped vehicles (the sum of the average stopped-vehicle distance 40 and the stopped-vehicle distance margin 41).

As illustrated in FIG. 9, the stopped-vehicle conditions include one that the brake lamps or the tail lamps of the vehicle are on (condition ID "002"). The stopped-vehicle evaluator 810 determines that the vehicle 2 satisfies the condition when the lighting status detector 804 detects the lighting-up of the brake lamps or the tail lamps of the vehicle 2. The lighting-up of the brake lamps means that the driver is in the driver's seat, making a braking operation such as stepping on the brake pedal, therefore, the driver is likely to temporarily stop the vehicle with no intention for parking. The tail lamps are included in this condition since tail lamps may double as brake lamps.

The stopped-vehicle conditions further include one that the vehicle is located near the center of the lane (condition ID "003"). The stopped-vehicle evaluator 810 determines whether the vehicle 2 satisfies the condition from the position of the vehicle 2 in the width direction of the adjacent lane determined by the vehicle detector 803. For example, when the difference in distance from the shoulder of the adjacent lane to the vehicle 2 and from the opposite end of the adjacent lane relative to the shoulder to the vehicle 2, both of which are calculated by the vehicle detector 803, is equal to or smaller than a given threshold, the stopped-vehicle evaluator 810 determines that the vehicle 2 is located near the center of the adjacent lane. The manner of the determination on whether the vehicle 2 is located near the center of the adjacent lane is not limited thereto. The stopped-vehicle evaluator 810 may also determine whether the vehicle 2 is located near the center of the ego lane or any other lane.

Generally, the vehicle 2 near the center of the lane is likely to temporarily stop, waiting for a traffic light to change, for example. For this reason, the condition ID "003" is given higher importance than the condition IDs "001" and "002". Thus, the condition ID "003" is given a relatively higher point.

The stopped-vehicle conditions also include one that a traffic light is detected ahead of the vehicle (condition ID "004"). The stopped-vehicle evaluator 810 determines that the vehicle 2 satisfies the condition when the traffic light detector 805 detects a traffic light ahead of the vehicle 2 from the captured image. The condition ID "004" may be such that a traffic light displaying red is detected ahead of the vehicle. In such a case, the stopped-vehicle evaluator 810 determines that the vehicle 2 satisfies the condition when the traffic light detector 805 detects a traffic light ahead of the vehicle 2 from the captured image, and when the detected traffic light displays red.

The stopped-vehicle conditions also include one that a motion of the stopped (not running) vehicle is detected (condition ID "005"). The stopped-vehicle evaluator 810 determines whether the vehicle 2 is in motion or not from a captured image newly received from the control device 10 by the receiver 801. For example, the vehicle detector 803 detects the vehicle 2 from the new captured image, and the inter-vehicle distance meter 806 measures the inter-vehicle distance 3 between the probe vehicle 1 and the vehicle 2. If the vehicle speed calculator 807 determines that the vehicle 2 is running (moving) from the amount of change in the measured inter-vehicle distance 3, the stopped-vehicle evaluator 810 determines that the vehicle 2 satisfies this condition. The manner of motion detection of the vehicle 2 is not limited thereto. The stopped-vehicle evaluator 810 may also use pattern matching to see whether the vehicle 2 detected from a previously received captured image and the vehicle 2 detected from a newly received captured image is the same vehicle.

The vehicle 2 in motion is very likely to be not a parked vehicle but a stopped vehicle. For this reason, a higher point is assigned to the condition ID "005" than to the other conditions. Alternatively, the stopped-vehicle evaluator 810 may be configured to determine the vehicle 2 as a stopped vehicle upon detecting a movement of the vehicle 2, and terminates the comparison with the conditions.

The stopped-vehicle conditions also include one that the imaging position is near a traffic light or a railroad crossing in the travelling direction of the probe vehicle (condition ID "051"). The stopped-vehicle evaluator 810 compares the corrected imaging position by the position corrector 809 with the positions of the traffic lights registered in the traffic-light position database 855 and the positions of the railroad crossings registered in the railroad-crossing position database 856. The stopped-vehicle evaluator 810 also determines whether there is any traffic light or railroad crossing in the travelling direction of the probe vehicle 1 from the positions of the roads registered in the digital map 851.

When the distance from the corrected imaging position to the traffic light or railroad crossing is equal to or smaller than a given threshold, and the traffic light or railroad crossing is located in the travelling direction of the probe vehicle 1, the stopped-vehicle evaluator 810 determines that the corrected imaging position is in the vicinity of the traffic light or railroad crossing in the travelling direction of the probe vehicle 1. The threshold of the distance from the corrected imaging position to the traffic light or railroad crossing in this condition is set to 50 meters, for example, but is not limited thereto. The stopped-vehicle evaluator 810 may simply determine whether the corrected imaging position is near the traffic light or railroad crossing, regardless of the travelling direction of the probe vehicle 1.

The stopped-vehicle conditions also include one that the ratio at which vehicles detected at the imaging position are found as stopped vehicles in the past history is equal to or higher than a threshold (condition ID "052"). The stopped-vehicle evaluator 810 searches the history database 852 illustrated in FIG. 7, and acquires a record matching the corrected imaging position. The stopped-vehicle evaluator 810 may acquire, from the history database 852, the imaging position not a perfect match with the corrected imaging position but falling within a given area from the corrected imaging position. The stopped-vehicle evaluator 810 may then calculate the ratio of the number of results determined as "stopped vehicle" to all the acquired records, and determine that the vehicle 2 satisfies the condition when the ratio is equal to or higher than the threshold. The threshold in the condition may be set to 70 percent, for example, but is not limited thereto.

The stopped-vehicle conditions also include one that the imaging position is near a bus stop (condition ID "053"). The stopped-vehicle evaluator 810 compares the imaging position corrected by the position corrector 809 with the positions of the bus stops registered in the bus-stop position database 853. If the distance from the corrected imaging position to the bus stop in question is equal to or smaller than a given threshold, the stopped-vehicle evaluator 810 determines that the corrected imaging position is near the bus stop. The threshold in the condition may be set to 30 meters, for example, but is not limited thereto.

The stopped-vehicle conditions also include one that the imaging position is away from a parking meter (condition ID "054"). The stopped-vehicle evaluator 810 compares the imaging position corrected by the position corrector 809 with the positions of the parking meters registered in the parkable spot database 854. If the distance from the corrected imaging position to the parking meter in question is equal to or larger than a given threshold, the stopped-vehicle evaluator 810 determines that the corrected imaging position is away from the parking meter. The threshold in the condition may be set to 20 meters, for example, but is not limited thereto. With error in the imaging position measured based on the GPS signal or a long inter-vehicle distance 3 between the imaging position of the probe vehicle 1 and the vehicle 2 taken into account, the threshold is set to a larger value than a typical distance from a parking meter to the end of a parking spot.

The parked-vehicle evaluator 811 calculates, for the not-running vehicle 2, a parked-vehicle evaluation value indicating the possibility of the vehicle 2 being a parked vehicle, based on one or more parked-vehicle conditions defining the characteristics of a parked vehicle at a stop for a certain length of time being equal to or longer than the threshold.

Specifically, the parked-vehicle evaluator 811 determines whether the vehicle 2 satisfies each of the parked-vehicle conditions. In other words, the parked-vehicle evaluator 811 determines whether the vehicle 2 shows the characteristics of a parked vehicle. The parked-vehicle evaluator 811 then calculates a parked-vehicle evaluation value by adding (summing up) the points corresponding to the parked-vehicle conditions satisfied by the vehicle 2. The parked-vehicle evaluation value represents the possibility of the vehicle 2 being a parked vehicle. The parked-vehicle evaluation value also indicates the likeliness of the vehicle being a parked vehicle.

As illustrated in FIG. 9, the parked-vehicle conditions include one that the inter-vehicle distance concerned is equal to or larger than a threshold of the inter-vehicle distance between the parked vehicles (condition ID "101"). Generally, the inter-vehicle distance between the parked vehicles is larger than the inter-vehicle distance between the stopped vehicles. A parked-vehicle distance margin 42 illustrated in FIG. 10 is a lower limit of an increase from the average stopped-vehicle distance 40 when the vehicle 2 is assumed to be a parked vehicle. The sum of the average stopped-vehicle distance 40 and the parked-vehicle distance margin 42 is an example of the threshold of the inter-vehicle distance between the parked vehicles according to the embodiment, and is an example of a fourth threshold according to the embodiment.

If the inter-vehicle distance 39 between the vehicle 2 and another vehicle 36 is equal to or larger than the threshold of the inter-vehicle distance between the parked vehicles (the sum of the average stopped-vehicle distance 40 and the parked-vehicle distance margin 42), the parked-vehicle evaluator 811 determines that the vehicle 2 satisfies the condition. No detection of other vehicles ahead of the vehicle 2 by the vehicle detector 803 may signify that another vehicle 36 is further away from the vehicle 2 beyond the distance within the field of view of the captured image. In such a case, the parked-vehicle evaluator 811 may regard the inter-vehicle distance 39 between the vehicle 2 and another vehicle 36 as being equal to or larger than the threshold of the inter-vehicle distance between the parked vehicles, and determine that the vehicle 2 satisfies the condition. Alternatively, the parked-vehicle evaluator 811 may disregard the points assigned to both the conditions IDs "001" and "101".

In the embodiment, as illustrated in FIG. 10, the stopped-vehicle distance margin 41 is smaller than the parked-vehicle distance margin 42, which creates an area in-between the inter-vehicle distance between the stopped vehicles and the inter-vehicle distance between the parked vehicles. This area renders a result of the determination on the vehicle unknown. If the inter-vehicle distance 39 between the vehicle 2 and another vehicle 36 is included in the area, the parked-vehicle evaluator 811 does not add any point.

The amounts of the stopped-vehicle distance margin 41 and the parked-vehicle distance margin 42 are not limited to the examples illustrated in FIG. 10. For example, the stopped-vehicle distance margin 41 may be larger than the parked-vehicle distance margin 42. In this case, the inter-vehicle distance between the stopped vehicles overlaps with the inter-vehicle distance between the parked vehicles. In such a case, the condition ID "001" may be such that the inter-vehicle concerned is equal to or smaller than the threshold of the inter-vehicle distance between the stopped vehicles, and smaller than the threshold of the inter-vehicle distance between the parked vehicles. Alternatively, the condition ID "101" may be such that the inter-vehicle distance concerned is larger than the threshold of the inter-vehicle distance between the stopped vehicles.

As illustrated in FIG. 9, the parked-vehicle conditions include one that the hazard lamps of the vehicle are flashing (condition ID "102"). The lighting-up of the hazard lamps of the vehicle 2 likely indicates that the driver signals his or her intension to park. When the lighting status detector 804 detects the flashing hazard lamps of the vehicle 2, the parked-vehicle evaluator 811 determines that the vehicle 2 satisfies the condition. Note that the parked-vehicle condition ID "102" may be excluded in such countries that it is not customary for the driver to flash the hazard lamps at the time of parking the vehicle 2.

The parked-vehicle conditions include one that the imaging time is during the night, and the brake lamps and the tail lamps are off (condition ID "103"). The lighting-off of the brake lamps and the tail lamps despite the stop of the vehicle 2 likely indicates that the engine has been stopped for a certain length of time matching or exceeding a given threshold. If the imaging time received by the receiver 801 is during the night, and the lighting status detector 804 detects the lighting-off of the brake lamps and the tail lamps of the vehicle 2, the parked-vehicle evaluator 811 determines that the vehicle 2 satisfies the condition. It is more difficult for the lighting status detector 804 to accurately detect the lighting-off of the brake lamps and the tail lamps during the daytime than during the night, so that this condition is limited to during the night. The night-time in the embodiment may be set to a time slot from sunset to sunrise varying depending on the season, or set to a fixed time slot.

Furthermore, the parked-vehicle conditions include one that the vehicle is located closer to the shoulder of a lane (condition ID "104"). As with the condition ID "003", the parked-vehicle evaluator 811 determines whether the vehicle 2 satisfies the condition, based on the position of the vehicle 2 in the width direction of the adjacent lane, determined by the vehicle detector 803. For example, if the distance between the shoulder of the adjacent lane and the vehicle 2, calculated by the vehicle detector 803, is equal to or smaller than a given threshold, the parked-vehicle evaluator 811 determines that the vehicle 2 is located near the shoulder of the adjacent lane. Alternatively, the parked-vehicle evaluator 811 may determine that the vehicle 2 is located near the shoulder when the left-side (shoulder side) white line of the adjacent lane is hidden by the body of the vehicle 2 in the captured image. Generally, vehicles may temporarily stop at a position closer to the shoulder to make a left turn, while waiting for a traffic light to change. Thus, this condition is given a smaller point than the condition ID "003".

The parked-vehicle conditions include one that the imaging position is away from a traffic light and a railroad crossing (condition ID "151"). The parked-vehicle evaluator 811 compares the corrected imaging position by the position corrector 809 with the positions of the traffic lights registered in the traffic-light position database 855 and the positions of the railroad-crossings registered in the railroad crossing position database 856. If the distances from the corrected imaging position to the traffic light and to the railroad crossing in question are equal to or longer than the threshold, the parked-vehicle evaluator 811 determines that the vehicle 2 satisfies the condition. The threshold in this condition is set to a larger value, e.g., 100 meters than that for the stopped-vehicle condition ID "051", but is not limited thereto. If the distances from the corrected imaging position to the traffic light and to the railroad crossing in question fall between the two thresholds (a distance larger than 50 meters and smaller than 100 meters), neither the stopped-vehicle evaluator 810 nor the parked-vehicle evaluator 811 adds any point. As with the condition ID "051", the subjects of the determination may be limited to traffic lights and railroad crossings situated in the travelling direction of the probe vehicle 1.

Furthermore, the parked-vehicle conditions include one that the imaging position is away from a bus stop (condition ID "152"). The parked-vehicle evaluator 811 compares the corrected imaging position by the position corrector 809 with the positions of bus stops registered in the bus-stop position database 853. If the distance from the corrected imaging position to the bus stop in question is equal to or longer than a given threshold, the parked-vehicle evaluator 811 determines that the corrected imaging position is away from the bus stop. The threshold in this condition is set to a larger value, e.g., 80 meters than that for the stopped-vehicle condition ID "053, but is not limited thereto. If the distance from the corrected imaging position to the bus stop falls between the two thresholds (a distance larger than 30 meters and smaller than 80 meters), neither the stopped-vehicle evaluator 810 nor the parked-vehicle evaluator 811 adds any point.

The parked-vehicle conditions further include one that the level of shape match between the detected vehicle and a vehicle captured by another probe vehicle at the same imaging position is equal to or higher than a threshold (condition ID "153"). Detection of a vehicle similar to the vehicle 2 from a captured image by another probe vehicle 1 highly likely indicates that the vehicle 2 has remained at the same position for a certain length of time being the threshold of the stoppage time or longer. Specifically, the parked-vehicle evaluator 811 searches the history database 852 illustrated in FIG. 7, and acquires a record of the probe vehicle ID matching the corrected imaging position and different from that of the probe vehicle 1. The parked-vehicle evaluator 811 then performs pattern matching to the shapes of the vehicle 2 between the captured image acquired by the receiver 801 and the captured image registered in the acquired record, to find the level of match (similarity). The threshold in this condition is an example of a first threshold according to the embodiment.

In this condition, continuous stop of the vehicle 2 at the same position needs to be determined, therefore, the imaging time in the record acquired from the history database 852 may be limited to a certain range. For example, the parked-vehicle evaluator 811 may subject images captured in the last ten minutes to pattern matching. The range of the imaging time is, however, not limited thereto. Alternatively, among the previous images captured by other probe vehicles at the same imaging position as the probe vehicle 1, the images captured at the latest imaging time may be the subjects of pattern matching. The captured images acquired from the history database 852 may not be limited to those captured by other probe vehicles. For example, previously captured images by the probe vehicle 1, while repeatedly running the same road, may be subjected to pattern matching. The shape comparison between the vehicle 2 and the vehicles captured by other probe vehicles is not limited to the pattern matching, and the parked-vehicle evaluator 811 may use a known image retrieval.

The parked-vehicle conditions further include one that the imaging position is near a parking meter (condition ID "154"). The imaging position near a parking meter likely indicates that the vehicle 2 is parked at the parking spot where the parking meter in question is installed. Specifically, the parked-vehicle evaluator 811 compares the corrected imaging position by the position corrector 809 with the positions of parking meters registered in the parkable spot database 854. If the distance from the corrected imaging position to the parking meter in question is equal to or smaller than a given threshold, the parked-vehicle evaluator 811 determines that the corrected imaging position is near the parking meter. The threshold in the condition may be set to 10 meters, for example, but is not limited thereto. To clearly distinct between stopped vehicles and parked vehicles, the threshold in this condition is set to a smaller value than that in the condition ID "054".

The parked-vehicle conditions further include one that the ratio at which detected vehicles at the imaging position are found as parked in the past history matches or exceeds a threshold" (condition ID "155"). The parked-vehicle evaluator 811 searches the history database 852 illustrated in FIG. 7, and acquires records matching the corrected imaging position. The parked-vehicle evaluator 811 then calculates the ratio of the number of results determined as "parked vehicle" to all the acquired records, and determines that the vehicle 2 satisfies the condition when the ratio matches or exceeds the threshold. The threshold in this condition may be the same value or a different value as that in the condition ID "052".

The parked-vehicle conditions include one that the level of match between the detected vehicle-line pattern and a vehicle-line pattern, detected from a captured image by another probe vehicle at the same imaging position, is equal to or higher than a threshold (condition ID "156"). The parked-vehicle evaluator 811 searches the history database 852 illustrated in FIG. 7, and acquires the record of a probe vehicle ID matching the corrected imaging position and different from that of the probe vehicle 1. The parked-vehicle evaluator 811 then detects, as a vehicle line pattern, an image area corresponding to the vehicle-line pattern detected by the vehicle-line pattern detector 808 from the depth map registered in the acquired record. The parked-vehicle evaluator 811 matches the previous vehicle-line pattern detected from the depth map registered in the history database 852 with the vehicle-line pattern detected by the vehicle-line pattern detector 808, to find the level of match (similarity). Alternatively, the parked-vehicle evaluator 811 may match the entire depth map registered in the history database 852 with the entire depth map generated by the vehicle-line pattern detector 808. The threshold in this condition is an example of a second threshold according to the embodiment.

When the previous vehicle-line pattern detected from the depth map registered in the history database 852 and the vehicle-line pattern detected by the vehicle-line pattern detector 808 are similar to each other, it is highly likely that the vehicle-line including the vehicle 2 has remained at a stop at the same position for a certain length of time being equal to or longer than the threshold of the stoppage time. In this condition, the imaging time of the records acquired from the history database 852 may be limited to a certain range, as with the condition ID "153". The depth maps acquired from the history database 852 may not to be limited to those of other probe vehicles.

The stopped-vehicle evaluator 810 and the parked-vehicle evaluator 811 each determine whether the vehicle 2 satisfies the conditions in order of the condition IDs. The order of the determination is, however, not limited thereto. For example, the stopped-vehicle evaluator 810 and the parked-vehicle evaluator 811 may determine the satisfaction of the conditions in FIG. 9 in order of the conditions including common information (e.g., the inter-vehicle distance or the on/off status of the lamps). For example, the stopped-vehicle evaluator 810 and the parked-vehicle evaluator 811 may determine the satisfaction of the condition ID "001", the condition ID "101", the condition ID "002", and the condition ID "102" in this order.

The conditions illustrated in FIG. 9 are merely exemplary and not limited thereto. In the conditions IDs "051" to "054" and "151" to "156", the stopped-vehicle evaluator 810 and the parked-vehicle evaluator 811 use the corrected imaging position by the position corrector 809 in order to improve determination accuracy, but the embodiment is not limited thereto. For example, the stopped-vehicle evaluator 810 and the parked-vehicle evaluator 811 may make the determination according to the imaging position received by the receiver 801. The stopped-vehicle evaluator 810 and the parked-vehicle evaluator 811 may also use the position of the vehicle 2 identified by the position corrector 809, instead of the imaging position.

The stopped-vehicle evaluator 810 and the parked-vehicle evaluator 811 comprehensively find the stopped-vehicle evaluation value and the parked-vehicle evaluation value for the vehicle 2 based on the stopped-vehicle conditions and the parked-vehicle conditions, respectively. This makes the evaluation values less affected by error in the results or determinations in the individual conditions. Thus, the stopped-vehicle evaluator 810 and the parked-vehicle evaluator 811 can accurately calculate the stopped-vehicle evaluation value and the parked-vehicle evaluation value for the vehicle 2.

Referring back to FIG. 6, the determiner 812 determines whether the vehicle 2 is a stopped vehicle, a parked vehicle, or a status-unknown vehicle based on the stopped-vehicle evaluation value calculated by the stopped-vehicle evaluator 810 and the parked-vehicle evaluation value calculated by the parked-vehicle evaluator 811.

Specifically, the determiner 812 finds the difference between the stopped-vehicle evaluation value and the parked-vehicle evaluation value of the vehicle 2. With the stopped-vehicle evaluation value being larger than the parked-vehicle evaluation value by the difference being "10" or larger, the determiner 812 determines the vehicle 2 as a stopped vehicle. With the parked-vehicle evaluation value larger than the stopped-vehicle evaluation value by the difference being 10 or larger, the determiner 812 determines the vehicle 2 as a parked vehicle. With the difference being less than "10", the determiner 812 determines the vehicle 2 as a status-unknown vehicle. The value "10" is an example of a given value according to the embodiment but is not limited thereto.

The determiner 812 registers, in the history database 852, the determination result, the probe vehicle ID received by the receiver 801, the captured image received by the receiver 801, the imaging position corrected by the position corrector 809, the imaging time received by the receiver 801, and the condition IDs satisfied by the vehicle 2, the inter-vehicle distance 39 between the vehicle 2 and another vehicle 36 measured by the inter-vehicle distance meter 806, and the depth map generated by the vehicle-line pattern detector 808, in association with one another. The information registered in the history database 852 is merely exemplary and is not limited to the above.

The stopped-vehicle evaluator 810 and the parked-vehicle evaluator 811 according to the embodiment may be configured as one functional element. The stopped-vehicle evaluator 810, the parked-vehicle evaluator 811, and the determiner 812 according to the embodiment may be configured as one functional element.

The transmitter 813 transmits information to the traffic information provider 9 in accordance with the determination result from the determiner 812. Specifically, if the determiner 812 determines the vehicle 2 as a stopped vehicle, the transmitter 813 transmits the result (indicating that the vehicle 2 is a stopped vehicle), the position of the vehicle 2 identified by the position corrector 809, the imaging time received by the receiver 801, the condition IDs satisfied by the vehicle 2, and the distances from the corrected imaging position to a traffic light, to a railroad crossing, and to a bus stop to the traffic information provider 9. Upon receipt of the distances from the corrected imaging position to the traffic light, the railroad crossing, and the bus stop from the transmitter 813, the traffic information provider 9 can estimate the length of a line of vehicles waiting for a traffic light to change, for example.

If the determiner 812 determines the vehicle 2 as a parked vehicle, the transmitter 813 transmits the result (indicating that the vehicle 2 is a parked vehicle), the captured image received by the receiver 801, the position of the vehicle 2 identified by the position corrector 809, the imaging time received by the receiver 801, and the condition IDs satisfied by the vehicle 2 to the traffic information provider 9. Upon receipt of the captured image from the transmitter 813, the traffic information provider 9 can identify the vehicle 2 as illegally parked from the captured image, for instance.

If the determiner 812 determines the vehicle 2 as a status-unknown vehicle, the transmitter 813 refrains from transmitting any information to the traffic information provider 9. The information transmitted by the transmitter 813 is not limited to these examples.

The output 814 outputs the determination result by the determiner 812, the captured image associated with the determination result, the imaging time, and the imaging position to the display device 84, in association with one another. The output 814 may acquire the information from the determiner 812 for output, or may read the information from the history database 852 for output after the registration. In the embodiment, the output 814 outputs the corrected imaging position by the position corrector 809, but may output the imaging position before the correction.

Figure 11:
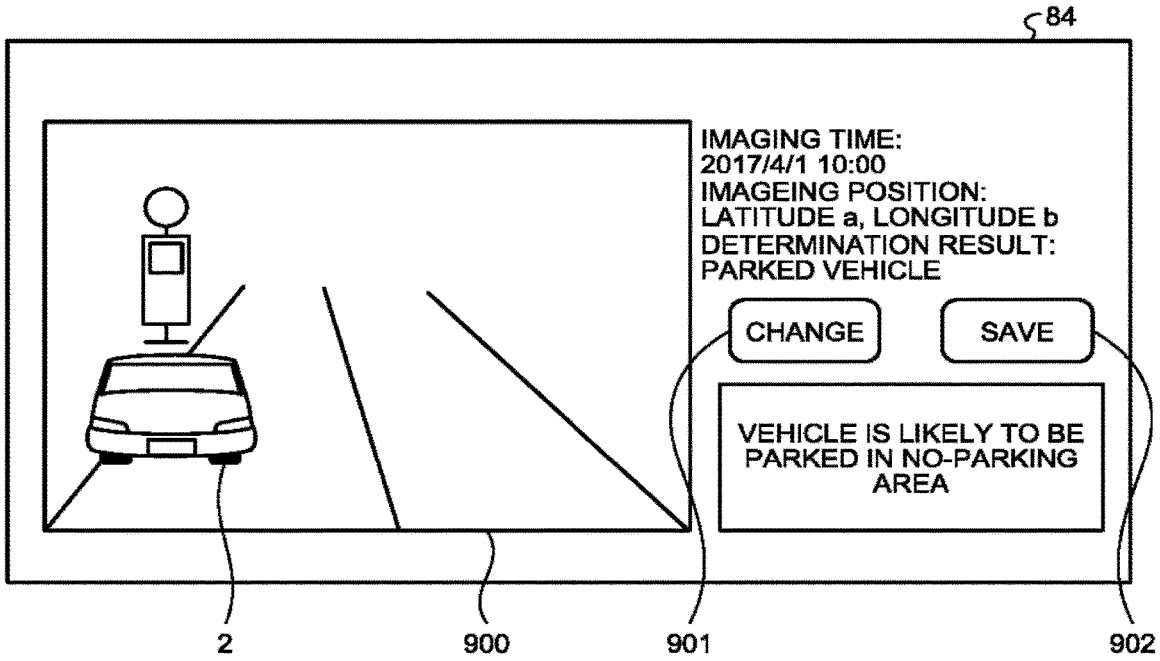
FIG. 11 is a schematic illustrating an exemplary output on the display in the first embodiment.

FIG. 11 is a schematic illustrating an exemplary output on the display in the embodiment. As illustrated in FIG. 11, the output 814 outputs a captured image 900, imaging time, imaging position, and a determination result to the display device 84. When the vehicle 2 is likely to be a parked vehicle in a no-parking area, the output 814 may notify a user of the vehicle 2 by display of a warning, an example of which is illustrated in FIG. 11. Specifically, the output 814 issues such a notification when the determiner 812 determines the vehicle 2 as a parked vehicle, and the distance between the imaging position and the no-parking area is equal to or smaller than a given threshold. No-parking areas are set in the vicinity of a traffic light, a railroad crossing, and a bus stop but not limited thereto. The value of the threshold may differ depending on the type of the no-parking area. The threshold is an example of a fifth threshold according to the embodiment. The output 814 may also determine that the vehicle 2 is likely to be parked in a no-parking area when the determiner 812 determines the vehicle 2 as a parked vehicle, and the vehicle 2 satisfies the condition ID "051" or ID "053".

The output 814 may display elements such as a change button 901 or a save button 902 on the display device 84, as illustrated in FIG. 11, with which a user can change the determination result. The display layout and functions illustrated in FIG. 11 are merely exemplary, and not limited thereto. For example, the output 814 may display the condition IDs satisfied by the vehicle 2 on the display. The output 814 may display thereon a list of captured images in association with the respective determination results. Furthermore, the output 814 may display a retrieval screen for allowing a user to retrieve past information from the history database 852, using imaging time or imaging position.

Referring back to FIG. 6, the receiver 815 receives a user's operation of the change button 901 or the save button 902. For example, upon receiving a user's press onto the change button 901 illustrated in FIG. 11, the receiver 815 allows the display of the determination result on the screen to be editable. Upon receiving a user's press onto the save button 902, the receiver 815 overwrites the corresponding result in the history database 852 with a changed determination result. The receiver 815 can receive determination results changed by a user, which can improve the accuracy of the previous determination results in the history database 852.

The process flow of the embodiment configured as above will now be explained.

Figure 12:
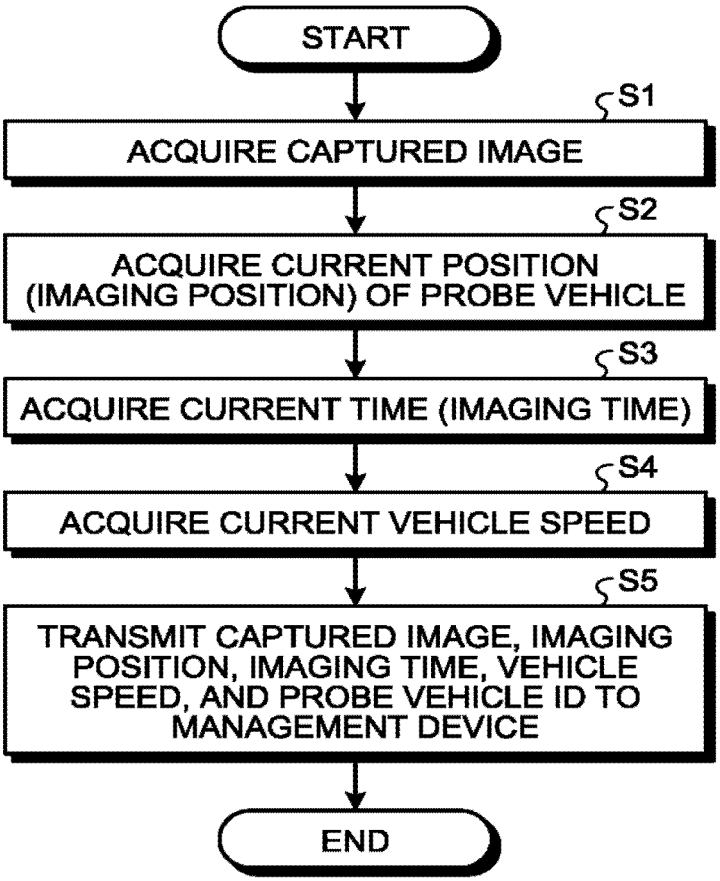
FIG. 12 is an exemplary flowchart of the process performed by the control device in the first embodiment.

FIG. 12 is a flowchart illustrating an example of the process performed by the control device 10 in the embodiment.

To begin with, the acquirer 110 acquires a captured image from the imaging device (S1). The acquirer 110 then acquires the current position of the probe vehicle 1 as an imaging position from the GPS module 105 (S2). The acquirer 110 also acquires the current time from the timer circuit 106 as imaging time (S3). The acquirer 110 also acquires the current vehicle speed of the probe vehicle 1 from the ECU (S4). The acquirer 110 then sends the acquired captured image, imaging position, imaging time, and vehicle speed to the transmitter 111.

The transmitter 111 transmits the captured image, the imaging position, the imaging time, and the speed of the probe vehicle 1 acquired by the acquirer 110 and the probe vehicle ID of the probe vehicle 1 to the management device 8, in association with one another (S5).

Figure 13:
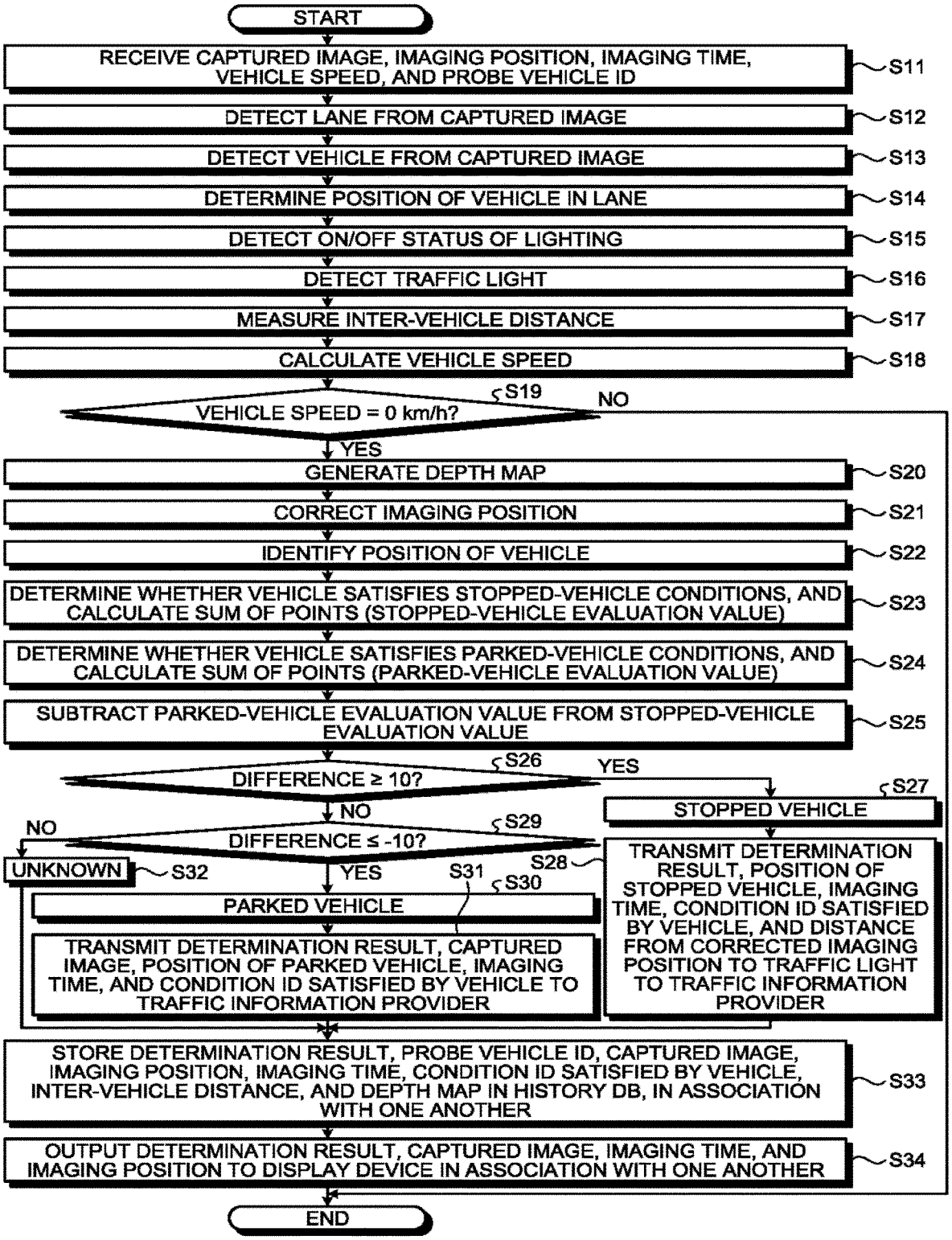
FIG. 13 is an exemplary flowchart of the process performed by the management device in the first embodiment.

FIG. 13 is a flowchart illustrating an example of the process performed by the management device 8 in the embodiment.

The receiver 801 receives a captured image, an imaging position, imaging time, the speed of the probe vehicle 1, and the probe vehicle ID of the probe vehicle 1 from the control device 10 (S11).

The lane detector 802 performs image processing to the frames of the captured image received by the receiver 801, and detects lanes from the frames (S12). The lane detector 802 also distinguishes between the ego lane in which the probe vehicle 1 is located and an adjacent lane of the detected lane.

The vehicle detector 803 detects the vehicle 2 from the captured image received by the receiver 801 (S13). The vehicle detector 803 also determines whether the detected vehicle 2 is located in the adjacent lane, based on the position of the detected vehicle 2 and the positions of the lanes detected by the lane detector 802 in the captured image. The vehicle detector 803 detects another vehicle 36 ahead of the vehicle 2 from the captured image received by the receiver 801.

The vehicle detector 803 determines the position of the vehicle 2 in the width direction of the adjacent lane (S14).

The lighting status detector 804 detects the on/off status of the lighting such as the brake lamps, the tail lamps, and the hazard lamps of the vehicle 2 detected by the vehicle detector 803, from the captured image received by the receiver 801 (S15).

The traffic light detector 805 detects a traffic light in the travelling direction of the vehicle 2 detected by the vehicle detector 803 from the captured image received by the receiver 801 (S16).

The inter-vehicle distance meter 806 measures the inter-vehicle distance 3 between the probe vehicle 1 and the vehicle 2, the inter-vehicle distance 37 between the probe vehicle 1 and another vehicle 36, and the inter-vehicle distance 39 between the vehicle 2 and another vehicle 36 in each of the frames of the captured image (S17).

The vehicle speed calculator 807 calculates the relative speed of the vehicle 2 with respect to the speed of the probe vehicle 1 from the amount of change in the inter-vehicle distance 3 between the probe vehicle 1 and the vehicle 2 measured by the inter-vehicle distance meter 806 within a certain time. The vehicle speed calculator 807 then calculates the speed of the vehicle 2 from the speed of the probe vehicle 1 received by the receiver 801 and the relative speed of the vehicle 2 with respect to the speed of the probe vehicle 1 (S18).

The vehicle speed calculator 807 then determines whether the speed of the vehicle 2 is 0 kilometers per hour (S19). If the speed of the vehicle 2 is not 0 kilometers per hour (No at S19), the vehicle speed calculator 807 determines that the vehicle 2 is running. In such a case, the process illustrated in the flowchart ends.

If the speed of the vehicle 2 is 0 kilometers per hour (Yes at S19), the vehicle speed calculator 807 determines that the vehicle 2 is not running.

If the vehicle speed calculator 807 determines that the vehicle 2 is not running, the vehicle-line pattern detector 808 generates a depth map from the captured image received by the receiver 801 (S20). The vehicle-line pattern detector 808 then detects, as a vehicle-line pattern, a given image area including the vehicle 2 detected by the vehicle detector 803 from the depth map generated from the captured image.

The position corrector 809 corrects the imaging position received by the receiver 801 to the position on the road, using the digital map 851 (S21). The position corrector 809 also identifies the position of the vehicle 2 based on the corrected imaging position and on the inter-vehicle distance 37 between the probe vehicle 1 and another vehicle 36 measured by the inter-vehicle distance meter 806 (S22).

The stopped-vehicle evaluator 810 determines whether the vehicle 2 detected by the vehicle detector 803 satisfies each of the stopped-vehicle conditions. The stopped-vehicle evaluator 810 also calculates the sum of the points (stopped-vehicle evaluation value) associated with the stopped-vehicle conditions satisfied by the vehicle 2 (S23).

The parked-vehicle evaluator 811 determines whether the vehicle 2 detected by the vehicle detector 803 satisfies each of the parked-vehicle conditions. The parked-vehicle evaluator 811 also calculates the sum of the points (parked-vehicle evaluation value) associated with the parked-vehicle conditions satisfied by the vehicle 2 (S24).

The determiner 812 then subtracts the parked-vehicle evaluation value from the stopped-vehicle evaluation value to find the difference therebetween (S25).

The determiner 812 determines whether the difference between the stopped-vehicle evaluation value and the parked-vehicle evaluation value is equal to or larger than "10" (S26). When the difference is equal to or larger than "10" (Yes at S26), the determiner 812 determines the vehicle 2 to be a stopped vehicle (S27). In such a case, the transmitter 813 transmits the determination result, the position of the stopped vehicle 2, the imaging time, the condition IDs satisfied by the vehicle 2, and the distances from the corrected imaging position to a traffic light, to a railroad crossing, and to a bus stop to the traffic information provider 9 (S28).

When the difference between the stopped-vehicle evaluation value and the parked-vehicle evaluation value is smaller than "10" (No at S26), the determiner 812 determines whether the difference is equal to or smaller than "−10" (S29). With the difference being equal to or smaller than "−10" (Yes at S29), the determiner 812 determines the vehicle 2 to be a parked vehicle (S30). In such a case, the transmitter 813 transmits the determination result, the captured image, the position of the parked vehicle 2, the imaging time, and the condition IDs satisfied by the vehicle 2 to the traffic information provider 9 (S31).

When the difference between the stopped-vehicle evaluation value and the parked-vehicle evaluation value is smaller than "10" and larger than "−10" (No at S26, No at S29), the determiner 812 determines the vehicle 2 to be a status-unknown (stopped or parked) vehicle (S32).

The determiner 812 then stores, in the history database 852, the determination result, the probe vehicle ID, the captured image, the corrected imaging position, the imaging time, the condition IDs satisfied by the vehicle 2, the inter-vehicle distance 39 between the vehicle 2 and another vehicle 36, and the depth map, in association with one another (S33). The output 814 outputs the determination result, the captured image, the imaging time, and the imaging position to the display device 84, in association with one another (S34).

Thus, the management device 8 according to the embodiment determines the not-running vehicle 2 as stopped or parked from the stopped-vehicle evaluation value calculated based on the one or more stopped-vehicle conditions and the parked-vehicle evaluation value calculated based on the one or more parked-vehicle conditions. Thereby, the management device 8 can accurately determine whether the vehicle 2 is a parked vehicle or a stopped vehicle.

More specifically, the management device 8 according to the embodiment determines whether the vehicle 2 is a stopped vehicle or a parked vehicle based on the difference between the stopped-vehicle evaluation value and the parked-vehicle evaluation value. Thus, even when the vehicle 2 satisfies both the conditions for a stopped vehicle and a parked vehicle, the management device 8 according to the embodiment can accurately determine the vehicle 2 as stopped or parked by relatively evaluating the likelihood of the vehicle 2 being a stopped vehicle or a parked vehicle.

In more detail, with the difference between the stopped-vehicle evaluation value and the parked-vehicle evaluation value being a given value or larger, the management device 8 according to the embodiment determines the vehicle 2 as a stopped vehicle when the stopped-vehicle evaluation value is larger, and determines the vehicle 2 as a parked vehicle when the parked-vehicle evaluation value is larger. With the difference between the stopped-vehicle evaluation value and the parked-vehicle evaluation value being smaller than the given value, the management device 8 according to the embodiment determines the vehicle 2 as a status-unknown vehicle. In this manner, the management device 8 according to the embodiment can exclude status-unknown vehicles and subject only the possible stopped or parked vehicle 2 to the determination, therefore, can reduce erroneous determinations.

In the management device 8 according to the embodiment, the stopped-vehicle evaluator 810 calculates the stopped-vehicle evaluation value by summing up the points associated with the stopped-vehicle conditions satisfied by the vehicle 2, among all the stopped-vehicle conditions. Likewise, the parked-vehicle evaluator 811 calculates a parked-vehicle evaluation value by summing up the points associated with the parked-vehicle conditions satisfied by the vehicle 2, among all the parked-vehicle conditions. Thus, the management device 8 according to the embodiment can reduce errors or erroneous determinations in the individual conditions, and accurately determine whether the vehicle 2 is a parked vehicle or a stopped vehicle.

In the management device 8 according to the embodiment, the parked-vehicle conditions include the one that the level of shape match between the vehicle 2 detected from the captured image and a previously detected vehicle by another probe vehicle at the same imaging position at time prior to the imaging time is equal to or higher than the first threshold. Thus, the management device 8 according to the embodiment can determine that the vehicle 2 has continuously remained at the same position without a fixed camera, and accurately determine the possibility of the vehicle 2 being a parked vehicle.

In the management device 8 according to the embodiment, the parked-vehicle conditions include the one that the level of match between the current vehicle-line pattern and a previously detected vehicle-line pattern by another probe vehicle at the same imaging position at time prior to the imaging time is equal to or higher than the second threshold. Thus, the management device 8 according to the embodiment can confirm that the vehicle-line including the vehicle 2 has continuously remained at the same position, and accurately determine the possibility of the vehicle 2 being a parked vehicle.

In the management device 8 according to the embodiment, the stopped-vehicle conditions include the one that the inter-vehicle distance 39 between the vehicle 2 and another vehicle 36 is equal to or smaller than the third threshold. Likewise, in the management device 8 according to the embodiment, the parked-vehicle conditions include the one that the inter-vehicle distance 39 between the vehicle 2 and another vehicle 36 is equal to or larger than the fourth threshold larger than the third threshold. Thus, the management device 8 according to the embodiment can set different thresholds of the inter-vehicle distances for stopped vehicles and parked vehicles to distinguish them and thereby reduce erroneous determination on a parked vehicle and a stopped vehicle.

In the management device 8 according to the embodiment, the stopped-vehicle conditions include the one that the vehicle 2 is located near the center of the lane. The parked-vehicle conditions include the one that the vehicle 2 is located closer to the shoulder of the lane. Thus, the management device 8 according to the embodiment further accurately determine whether the vehicle 2 is a parked vehicle or a stopped vehicle, according to the driver's intention to stop or park the vehicle 2, which is inferable from the position of the vehicle 2 in the width direction of the lane.

In the management device 8 according to the embodiment, the stopped-vehicle conditions include the one that the brake lamps or the tail lamps of the vehicle 2 are on. In the management device 8 according to the embodiment, the parked-vehicle conditions include the one that the hazard lamps of the vehicle 2 are flashing. Thus, the management device 8 according to the embodiment can further accurately determine whether the vehicle 2 is a parked vehicle or a stopped vehicle, according to the driver's intention to stop or park the vehicle 2, which is inferable from the on/off status of the lamps.

In the management device 8 according to the embodiment, the stopped-vehicle conditions include the one that the imaging position is near a traffic light or a railroad crossing. The parked-vehicle conditions include the one that the imaging position is near a parking meter. Thus, the management device 8 according to the embodiment can further accurately determine whether the vehicle 2 is a parked vehicle or a stopped vehicle depending on the location of the vehicle 2, that is, a typical location where vehicles are likely to stop or park.

In the management device 8 according to the embodiment, the storage 850 stores results of the determination, the captured image, and the imaging time, and the imaging position of the captured image, in association with one another. Thus, the management device 8 according to the embodiment can utilize the accumulated previous information for improving the determination accuracy. Furthermore, in the management device 8 according to the embodiment, the output 814 outputs the captured image and the determination result from the storage 850, in association with each other. Thus, the management device 8 according to the embodiment enables a user to easily check the captured image and the determination result.

In the management device 8 according to the embodiment, the output 814 issues a notification that the vehicle 2 is likely to be parked in a no-parking area, when the determiner 812 determines the vehicle 2 as a parked vehicle, and the distance between the imaging position and the no-parking area is equal to or smaller than the fifth threshold. Thus, the management device 8 according to the embodiment can allow a user to easily identify, from among other parked vehicles, the vehicle 2 to which the user needs to pay a special attention.

Second Embodiment

In the first embodiment, the management device 8 deal with all the determinations, i.e., as to whether the vehicle 2 satisfies each of the conditions. In a second embodiment, the control device 10 in the probe vehicle 1 deals with part of the determinations.

The overall configuration of an information processing system S, the configuration around the cockpit of the probe vehicle 1, and the hardware configurations of the control device 10 and the management device 8 according to the second embodiment are the same as those according to the first embodiment with reference to FIGS. 1 to 3, and 5.

Figure 14:
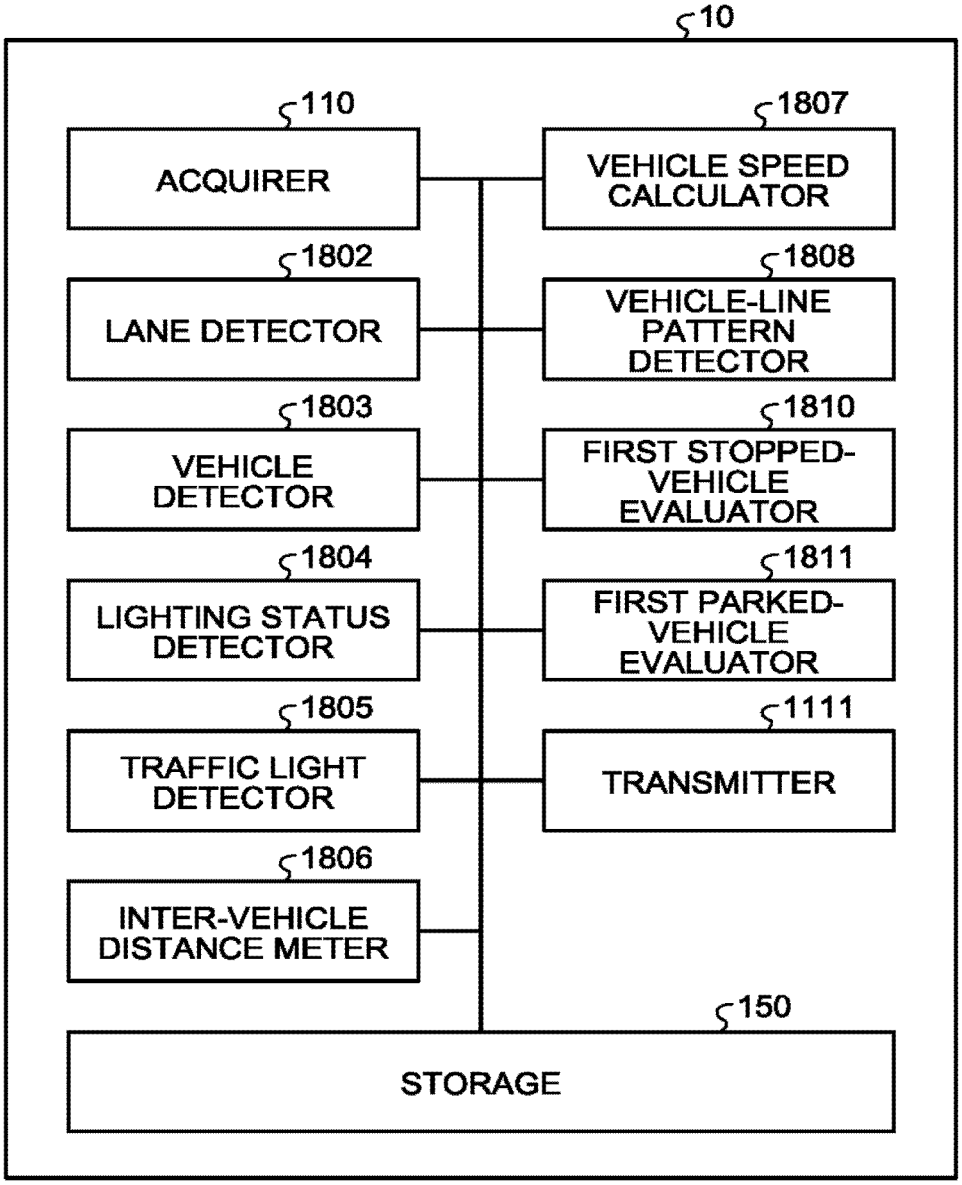
FIG. 14 is a block diagram illustrating an example of functions of a control device of a probe vehicle according to a second embodiment.

FIG. 14 is a block diagram illustrating exemplary functions of the control device 10 of the probe vehicle 1 according to the embodiment. As illustrated in FIG. 14, the control device 10 according to the embodiment includes part of the functions of the management device 8 according to the first embodiment with reference to FIG. 6, in addition to the functional configuration according to the first embodiment with reference to FIG. 4. Specifically, the control device 10 includes a lane detector 1802, a vehicle detector 1803, a lighting status detector 1804, a traffic light detector 1805, an inter-vehicle distance meter 1806, a vehicle speed calculator 1807, a vehicle-line pattern detector 1808, a first stopped-vehicle evaluator 1810, and a first parked-vehicle evaluator 1811, in addition to the acquirer 110, a transmitter 1111, and the storage 150.

The acquirer 110, the storage 150, the lane detector 1802, the vehicle detector 1803, the lighting status detector 1804, the traffic light detector 1805, the inter-vehicle distance meter 1806, the vehicle speed calculator 1807, and the vehicle-line pattern detector 1808 have the same functions as those according to the first embodiment.

The first stopped-vehicle evaluator 1810 determines whether the vehicle 2 satisfies the stopped-vehicle condition IDs "001" to "005" illustrated in FIG. 9. The first parked-vehicle evaluator 1811 determines whether the vehicle 2 satisfies the parked-vehicle condition IDs "101" to "104" illustrated in FIG. 9. The first stopped-vehicle evaluator 1810 and the first parked-vehicle evaluator 1811 make the determinations in the same manner as the stopped-vehicle evaluator 810 and the parked-vehicle evaluator 811 according to the first embodiment, respectively.

The condition IDs "001" to "005" and "101" to "104" do not require the information stored in the digital map 851, the history database 852, the bus-stop position database 853, the parkable spot database 854, the traffic-light position database 855, and the railroad-crossing position database 856, eliminating the necessity for the control device 10 to store therein a large amount of data. The conditions assigned to the first stopped-vehicle evaluator 1810 and the first parked-vehicle evaluator 1811 are merely exemplary, and the first stopped-vehicle evaluator 1810 and the first parked-vehicle evaluator 1811 may be configured to make determinations for the other conditions. Further, the first stopped-vehicle evaluator 1810 and the first parked-vehicle evaluator 1811 may be configured as one functional element.

The transmitter 1111 according to the embodiment transmits, to the management device 8, the condition IDs satisfied by the vehicle 2, the depth map, the inter-vehicle distance 3 between the probe vehicle 1 and the vehicle 2, and the inter-vehicle distance 39 between the vehicle 2 and another vehicle 36, in addition to the captured image, the imaging position, the imaging time, the probe vehicle ID of the probe vehicle 1 stored in the storage 150, in association with one another. In the embodiment, the control device 10 includes the vehicle speed calculator 1807 which uses the speed of the probe vehicle 1, so that the transmitter 1111 does not need to transmit the speed of the probe vehicle 1 to the management device 8. The transmitter 1111 may transmit the sum of the points for the stopped-vehicle conditions satisfied by the vehicle 2 and the sum of the points for the parked-vehicle conditions satisfied by the vehicle 2, instead of the condition IDs satisfied by the vehicle 2.

Furthermore, the transmitter 1111 may transmit the history of the last several imaging positions acquired, in addition to the current (latest) imaging position of the vehicle 2. For example, the transmitter 1111 transmits three previously acquired imaging positions together with the latest imaging position, which enables the management device 8 to identify the traveling direction of the vehicle 2 and more accurately correct the position of the vehicle 2.

Figure 15:
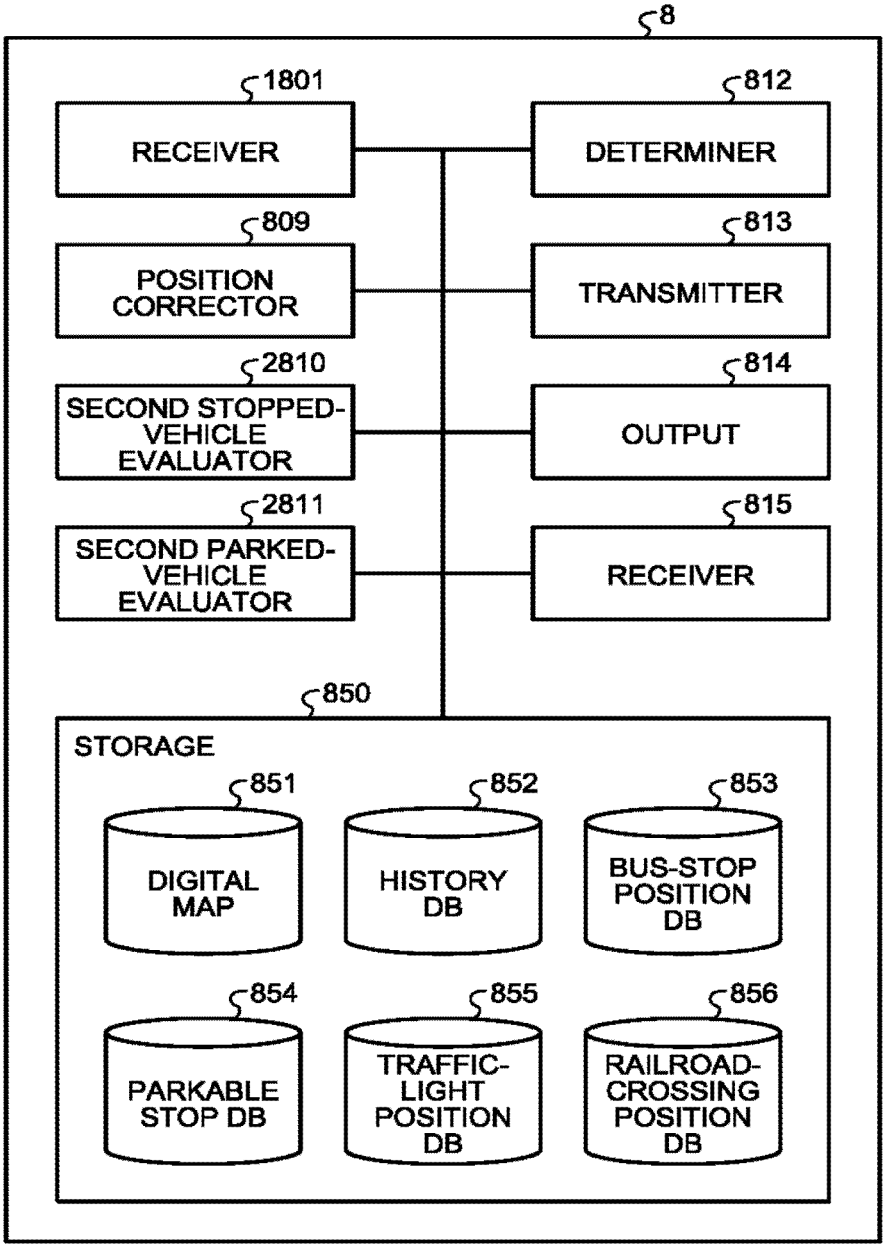
FIG. 15 is a block diagram illustrating an example of functions of a management device in the second embodiment.

FIG. 15 is a block diagram illustrating exemplary functions of the management device 8 in the second embodiment. As illustrated in FIG. 15, the management device 8 according to the embodiment includes a receiver 1801, the position corrector 809, a second stopped-vehicle evaluator 2810, a second parked-vehicle evaluator 2811, the determiner 812, the transmitter 813, the output 814, the receiver 815, and the storage 850.

The position corrector 809, the transmitter 813, the output 814, the determiner 812, the receiver 815, and the storage 850 have the same functions as those according to the first embodiment with reference to FIG. 6.

The receiver 1801 according to the embodiment receives the condition IDs satisfied by the vehicle 2, the depth map, the inter-vehicle distance 3 between the probe vehicle 1 and the vehicle 2, and the inter-vehicle distance 39 between the vehicle 2 and another vehicle 36, in addition to the captured image, the imaging position, the imaging time, and the probe vehicle ID.

The second stopped-vehicle evaluator 2810 determines whether the vehicle 2 satisfies each of the stopped-vehicle condition IDs "051" to "054" illustrated in FIG. 9, and adds (sums up) the points for the stopped-vehicle conditions satisfied by the vehicle 2. The second stopped-vehicle evaluator 2810 also adds (sums up) the points for the stopped-vehicle conditions satisfied by the vehicle 2 as determined by the first stopped-vehicle evaluator 1810 of the control device 10. The second stopped-vehicle evaluator 2810 then calculates the stopped-vehicle evaluation value of the vehicle 2 by adding these sums of the points.

The second parked-vehicle evaluator 2811 determines whether the vehicle 2 satisfies the parked-vehicle condition IDs "151" to "156", and adds (sums up) the points for the parked-vehicle conditions satisfied by the vehicle 2. The second parked-vehicle evaluator 2811 adds (sums up) the points for the parked-vehicle conditions satisfied by the vehicle 2 as determined by the first parked-vehicle evaluator 1811. The second parked-vehicle evaluator 2811 then calculates the parked-vehicle evaluation value of the vehicle 2 by adding these sums. The second stopped-vehicle evaluator 2810 and the second parked-vehicle evaluator 2811 make the determinations in the same manner as those according to the first embodiment.

The second stopped-vehicle evaluator 2810 and the second parked-vehicle evaluator 2811 according to the embodiment may be configured as one functional element. The second stopped-vehicle evaluator 2810, the second parked-vehicle evaluator 2811, and the determiner 812 may also be configured as one functional element.

The process flow by the above embodiment will now be explained.

Figure 16:
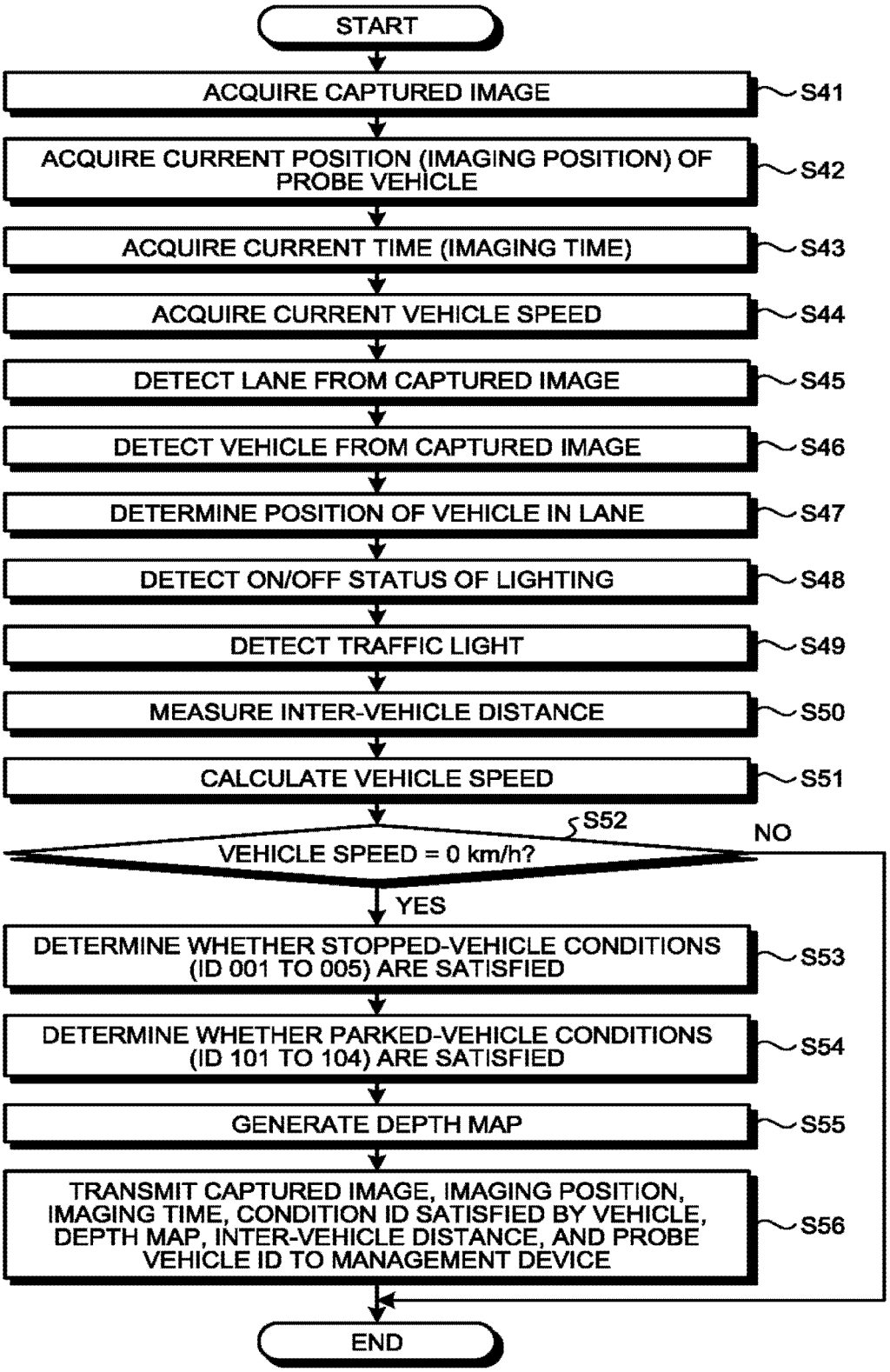
FIG. 16 is an exemplary flowchart of the process performed by the control device in the second embodiment.

FIG. 16 is a flowchart illustrating an example of the process performed by the control device 10 according to the embodiment.

The process from the acquisition of a captured image at S41 to the acquisition of the current vehicle speed at S44 is the same as the process at S1 to S4 illustrated in FIG. 12. The process from the detection of the lanes at S45 to the determination as to whether the speed of the vehicle 2 is 0 kilometers per hour at S52 is the same as the process at S12 to S19 illustrated in FIG. 13.

The first stopped-vehicle evaluator 1810 determines whether the vehicle 2 satisfies each of the stopped-vehicle condition IDs "001" to "005" (S53). The first parked-vehicle evaluator 1811 determines whether the vehicle 2 satisfies the parked-vehicle condition IDs "101" to "104" (S54).

The generation of a depth map at S55 is the same as that at S20 illustrated in FIG. 13.

The transmitter 1111 transmits, to the management device 8, the captured image, the imaging position, the imaging time, the condition IDs satisfied by the vehicle 2, the depth map, the inter-vehicle distance 3 between the probe vehicle 1 and the vehicle 2, the inter-vehicle distance 39 between the vehicle 2 and another vehicle 36, and the probe vehicle ID of the probe vehicle 1, in association with one another (S56).

Figure 17:
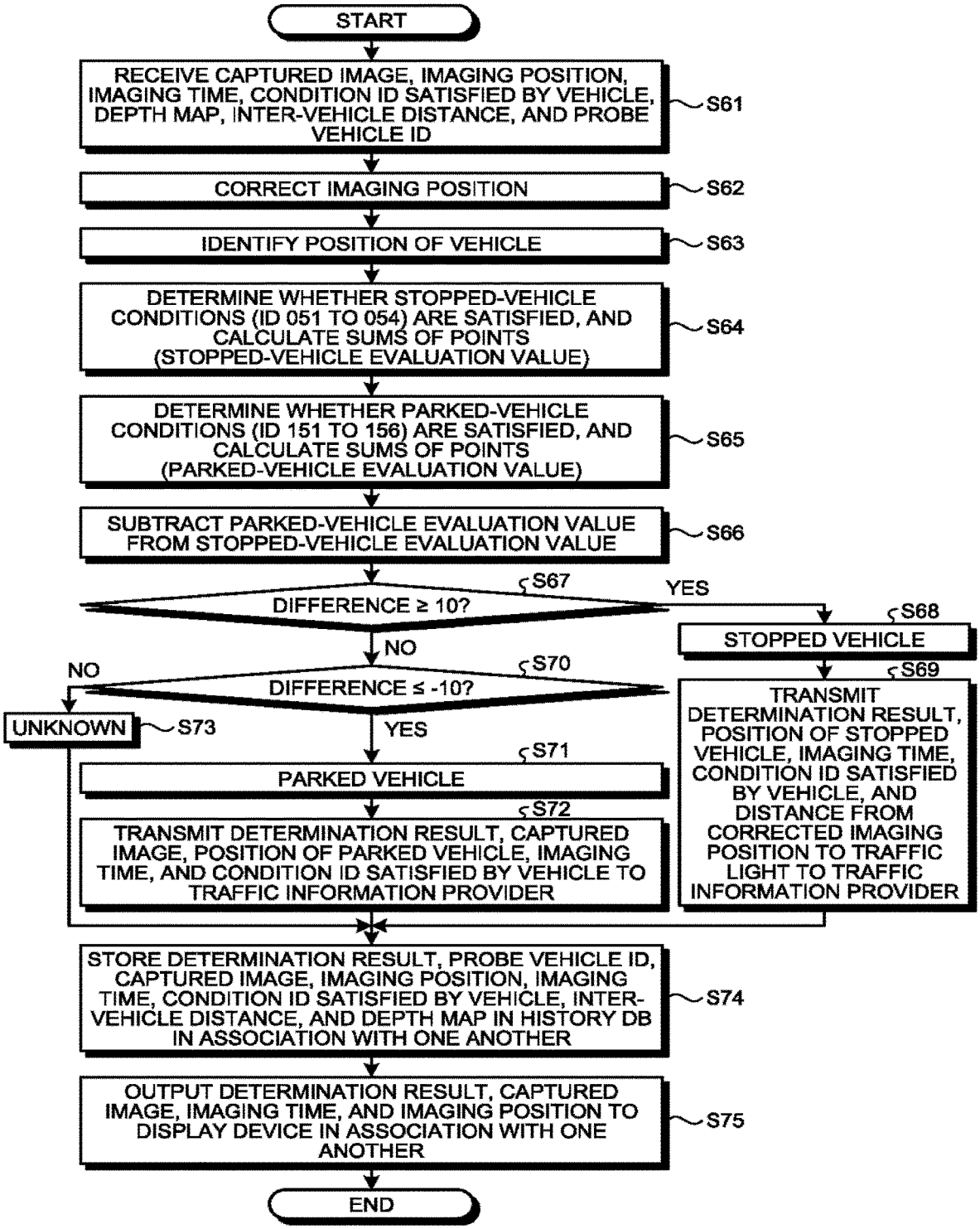
FIG. 17 is an exemplary flowchart of the process performed by the management device in the second embodiment.

FIG. 17 is a flowchart illustrating an example of the process performed by the management device 8 according to the embodiment.

The receiver 1801 receives, from the control device 10, the captured image, the imaging position, the imaging time, the condition IDs satisfied by the vehicle 2, the depth map, the inter-vehicle distance 3 between the probe vehicle 1 and the vehicle 2, the inter-vehicle distance 39 between the vehicle 2 and another vehicle 36, and the probe vehicle ID (S61).

The correction of the imaging position at S62 and identifying the position of the vehicle at S63 are the same as those at S21 and S22 illustrated in FIG. 13.

The second stopped-vehicle evaluator 2810 then determines whether the vehicle 2 satisfies the stopped-vehicle condition IDs "051" to "054", and adds the points for the stopped-vehicle conditions satisfied by the vehicle 2. The second stopped-vehicle evaluator 2810 also adds the points for the stopped-vehicle conditions satisfied by the vehicle 2 as determined by the first stopped-vehicle evaluator 1810 of the control device 10. The second stopped-vehicle evaluator 2810 then calculates the total of these sums of the points (the stopped-vehicle evaluation value of the vehicle 2) (S64).

The second parked-vehicle evaluator 2811 then determines whether the vehicle 2 satisfies the parked-vehicle condition IDs "151" to "156", and adds the points for the parked-vehicle conditions satisfied by the vehicle 2. The second parked-vehicle evaluator 2811 also adds the points for the parked-vehicle conditions satisfied by the vehicle 2 as determined by the first parked-vehicle evaluator 1811. The second parked-vehicle evaluator 2811 then calculates the total of these sums of the points (the parked-vehicle evaluation value of the vehicle 2) (S65).

The calculation of the difference between the stopped-vehicle evaluation value and the parked-vehicle evaluation value at S66 to the output to the display device 84 at S75 are the same as those at S25 to S34 illustrated in FIG. 13.

As described above, in the information processing system S according to the embodiment, the control device 10 of the probe vehicle 1 deals with the determination for part of the conditions and the vehicle detection accompanying thereto. This can reduce the processing load on the management device 8, in addition to the advantageous effects achieved by the first embodiment. Furthermore, in the information processing system S according to the embodiment, the control device 10 determines whether the vehicle 2 is running, which can reduce the amount of captured images transmitted from the control device 10 to the management device 8 and greatly reduce the amount of communication accordingly.

As explained above, the first and the second embodiments attain accurate determination on whether the vehicle 2 is a parked vehicle or a stopped vehicle.

First Modification

In the first embodiment, the management device 8 makes determinations for all of the conditions. In the second embodiment, the control device 10 and the management device 8 both make determinations for part of the conditions. By contrast, in the first modification, the control device 10 may be configured to make determinations for all the conditions.

Second Modification

In the first and the second embodiments, the transmitter 813 transmits the information to the traffic information provider 9, but the information to transmit is not limited to the examples explained above. For example, if the determiner 812 determines the vehicle 2 as a parked vehicle, and the vehicle 2 satisfies the condition ID "051" or ID "053", the transmitter 813 may notify the traffic information provider 9 of the information that the vehicle 2 is likely to be parked in a no-parking area.

Third Modification

The given difference between the stopped-vehicle evaluation value and the parked-vehicle evaluation value, used by the determiner 812 according to the first and the second embodiments to determine whether the vehicle 2 is a stopped vehicle, a parked vehicle, or a status-unknown vehicle, may not be a fixed value. For example, the given difference may differ depending on the time of day, the day of the week (e.g., weekdays, Saturday, Sunday, or holidays), month, or the season, for example. Alternatively, a user may set the given difference to a desired value depending on the application of the information processing system S. With a larger difference set, the accuracy of the determination on the vehicle 2 as a stopped or parked vehicle is further improved, which can reduce erroneous determination. With a smaller difference set, the ratio at which the vehicle 2 is determined to be a status-unknown vehicle is reduced, which is useful depending on the usage of the determination results.

Fourth Modification

The thresholds used in the conditions in the first and the second embodiments do not need to be fixed values. For example, depending on geographical conditions, e.g., in the vicinity of a sharp curve, the vehicle 2 may be located closer to the shoulder or the center of the lane than general. The position of the vehicle 2 in the width direction of the lane may differ from general depending on geographical conditions including a sharp curve. To reduce erroneous determinations in such situations, the thresholds used in the conditions IDs "001", "003", "101", and "104" may be set to different values in accordance with the imaging position or the position of the vehicle 2.

Fifth Modification

The points corresponding to the conditions according to the first and the second embodiments are not limited to the values illustrated in FIG. 9. For example, the accuracy of determination for part of the conditions may lower, affected by sunlight, for example. Thus, the points associated with the conditions may be changed depending on time, for example. Specifically, for the determination based on the on/off status of the lighting as the condition IDs "002" and "102", lower points may be applied when the imaging time is during the daytime, and higher points may be applied when the imaging time is during the night. Sunset or sunrise time differs depending on the month of the year or the season, therefore, the start and end of the daytime or night-time may be changed depending on the month of the year or the season.

The accuracy of determination for part of the conditions may lower depending on geographical conditions, e.g., in the vicinity of a sharp curve or no white lines indicating lanes. In such a case, the points may be changed depending on the imaging position or the position of the vehicle 2.

Furthermore, the points corresponding to the conditions may be changeable after start of the operation of the information processing system S. For example, the receiver 815 may be configured to receive changed points from a user. Alternatively, the management device 8 may learn user's changes in the determination results to change the points corresponding to the conditions on the basis of the learning.

Sixth Modification

The conditions according to the first and the second embodiments are merely exemplary, and are not limited thereto. For example, other conditions than those illustrated in FIG. 9 may be added, or part of the conditions may be excluded. For example, the probe vehicle 1 may include an infrared camera which images the vehicle 2 to measure the temperature of the muffler in the vehicle 2. In such a case, the stopped-vehicle conditions may include a condition that the muffler temperature is equal to or higher than a threshold. The parked-vehicle conditions may include a condition that the muffler temperature is lower than a threshold. Furthermore, the vehicle detector 803, 1803 may detect the driver in the driver's seat of the vehicle 2. In such a case, the stopped-vehicle conditions may include a condition that the driver is in the driver's seat of the vehicle 2. The parked-vehicle conditions may include a condition that the driver is not in the driver's seat of the vehicle 2.

Seventh Modification

In the first and the second embodiments, the control device 10 acquires the position of the probe vehicle 1 from the GPS signal, but any of other known techniques may be used. For example, the acquirer 110 or the vehicle detectors 803, 1803 may identify the position of the probe vehicle 1 by detecting a marker from the captured image by the imaging device. Alternatively, the acquirer 110 may identify the position of the probe vehicle 1 using Bluetooth (registered trademark). When the probe vehicle 1 is running at a location where GPS signals are not easily receivable, e.g., inside a tunnel, or where position identification is difficult, e.g., under a railway girder, the acquirer 110 may adopt both the alternative technique and the GPS signals or switch therebetween.

Eighth Modification

In the first and the second embodiments, the position corrector 809 corrects the imaging position using the digital map 851, but any other method may be used. For example, the acquirer 110 may acquire the corrected position of the probe vehicle 1 from a car navigation system of the probe vehicle 1.

The position corrector 809 may also acquire the position of the probe vehicle 1 from the control device 10 at intervals of several seconds, and correct the imaging position based on the result of matching the previous positions of the probe vehicle 1 with the digital map 851. Thereby, the position corrector 809 can accurately match the road position in the digital map 851 with the imaging position. Further, the position corrector 809 can correctly identify the travelling direction of the probe vehicle 1.

Ninth Modification

According to the first and the second embodiments, in the conditions IDs "052" and "155", the stopped-vehicle evaluator 810, for example, searches the history database 852, and calculates a ratio of stopped vehicles and a ratio of parked vehicles in the previous history. These ratios, however, may be calculated in advance. For example, upon every registration of a new determination result in the history database 852, the determiner 812 may calculate the ratios of stopped vehicles and parked vehicles in the previous history for storing in the storage 850. Alternatively, the determiner 812 may be configured to calculate these ratios during the night or during a time slot in which the processing load is low, as a background process. Furthermore, the determiner 812 may calculate various types of statistic information other than the ratios from the information registered in the history database 852. The ratios and the statistic information may be calculated in an external cloud environment, for example.

Tenth Modification

In the first and the second embodiments, the inter-vehicle distance meters 806, 1806 measure the inter-vehicle distances 3, 37, 39 from the captured image. Instead, the inter-vehicle distance meters 806, 1806 may acquire results of the detection from a distance meter as a radar or a sonar mounted on the probe vehicle to measure the inter-vehicle distances 3, 37, 39.

Eleventh Modification

In the first and the second embodiments, the various types of information (the digital map 851, the history database 852, the bus-stop position database 853, the parkable spot database 854, the traffic-light position database 855, and the railroad-crossing position database 856) are pre-stored in the storage 850. Instead, the data in the storage 850 may be updated from an external system, for example, on a regular basis even after start of the operation of the information processing system S. The various types of information may be stored in an external cloud environment, instead of the storage 850 of the management device 8.

Twelfth Modification

In the first and the second embodiments, the probe vehicle 1 and the vehicle 2 are both automobiles, as illustrated in FIG. 1, but they are not limited thereto. For example, the probe vehicle 1 may be a tram vehicle, a motorcycle, or an autonomous vehicle that runs on a road. The vehicle 2 as the object of the determination may be a tram vehicle.

The modifications described above may be applied to the first embodiment or the second embodiment solely or in combination.

The computer program executed by the control device 10 according to the first and the second embodiments is incorporated in a ROM in advance. The computer program executed by the control device 10 according to the first and the second embodiments may be recorded and provided in installable or executable file format on a computer-readable recording medium such as a compact disc read-only memory (CD-ROM), a flexible disk (FD), a compact disc recordable (CD-R), and a digital versatile disc (DVD). Furthermore, the computer program executed by the control device 10 according to the first and the second embodiments may be stored on a computer connected to a network such as the Internet, and made available for download over the network. The computer program executed by the control device 10 may be provided or distributed over a network such as the Internet.

The computer program executed by the control device 10 according to the first and the second embodiments has a module configuration including the above elements (the acquirer, the transmitter, the lane detector, the vehicle detector, the lighting status detector, the traffic light detector, the inter-vehicle distance meter, the vehicle speed calculator, the vehicle-line pattern detector, the first stopped-vehicle evaluator, and the first parked-vehicle evaluator). As the actual hardware, a CPU (processor) reads and executes the computer program from the ROM to be loaded onto the main memory, implementing the acquirer, the transmitter, the lane detector, the vehicle detector, the lighting status detector, the traffic light detector, the inter-vehicle distance meter, the vehicle speed calculator, the vehicle-line pattern detector, the first stopped-vehicle evaluator, and the first parked-vehicle evaluator on the main memory.

The computer program executed by the management device 8 according to the first and the second embodiments is recorded and provided in installable or executable file format on a computer-readable recording medium such as a CD-ROM, a flexible disk, a CD-R, and a DVD.

The computer program executed by the management device 8 according to the first and the second embodiments may be stored in a computer connected to a network such as the Internet, and made available for download over the network. Furthermore, the computer program executed by the management device 8 according to the first and the second embodiments may be provided or distributed over a network such as the Internet. The computer program executed by the management device 8 according to the first and the second embodiments may be incorporated in a ROM in advance.

The computer program executed by the management device 8 according to the first and the second embodiments has a module configuration including the above elements (the receiver, the lane detector, the vehicle detector, the lighting status detector, the traffic light detector, the inter-vehicle distance meter, the vehicle speed calculator, the vehicle-line pattern detector, the position corrector, the stopped-vehicle evaluator, the parked-vehicle evaluator, the second stopped-vehicle evaluator, the second parked-vehicle evaluator, the determiner, the transmitter, the output, and the receiver). As the actual hardware, a CPU reads and executes the computer program from the recording medium to be loaded onto the main memory, implementing the receiver, the lane detector, the vehicle detector, the lighting status detector, the traffic light detector, the inter-vehicle distance meter, the vehicle speed calculator, the vehicle-line pattern detector, the position corrector, the stopped-vehicle evaluator, the parked-vehicle evaluator, the second stopped-vehicle evaluator, the second parked-vehicle evaluator, the determiner, the transmitter, the output, and the receiver on the main memory.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An information processing apparatus comprising:

one or more processors configured to:

detect a vehicle from an image captured by an imaging device that is mounted in a probe vehicle;

determine whether the detected vehicle is running;

calculate, when the vehicle is not running, a sum of points associated with each of stopped-vehicle conditions satisfied by the vehicle detected from the captured image, as a stopped-vehicle evaluation value, the stopped-vehicle evaluation value indicating a possibility of the vehicle being a stopped vehicle, the stopped-vehicle conditions defining characteristics of a stopped vehicle that remains at a stop for a length of time being less than a given threshold;

calculate, when the vehicle is not running, a sum of points associated with each of parked-vehicle conditions satisfied by the vehicle detected from the captured image, as a parked-vehicle evaluation value, the parked-vehicle evaluation value indicating a possibility of the vehicle being a parked vehicle, the parked-vehicle conditions defining characteristics of a parked vehicle that remains at a stop for a length of time being equal to or more than the threshold; and determine whether the vehicle is a stopped vehicle or a parked vehicle based on the stopped-vehicle evaluation value and the parked-vehicle evaluation value, wherein the points associated with each of the stopped-vehicle conditions or the parked-vehicle conditions are different values depending on importance of the stopped-vehicle conditions or the parked-vehicle conditions.

2. The information processing apparatus according to claim 1, wherein the one or more processors determine whether the vehicle is a stopped vehicle or a parked vehicle based on a difference between the stopped-vehicle evaluation value and the parked-vehicle evaluation value.

3. The information processing apparatus according to claim 2, wherein the one or more processors determine:

the vehicle as a stopped vehicle when the difference is equal to or larger than a given value, and the stopped-vehicle evaluation value is larger than the parked-vehicle evaluation value, the vehicle as a parked vehicle when the difference is equal to or larger than the given value, and the parked-vehicle evaluation value is larger than the stopped-vehicle evaluation value, and the vehicle as a status-unknown vehicle when the difference is smaller than the given value, the status-unknown vehicle being a vehicle that cannot be determined as stopped or parked.

4. The information processing apparatus according to claim 1, wherein the parked-vehicle conditions include a parked-vehicle condition that a level of shape match between the vehicle detected from the captured image and a previously detected vehicle by another probe vehicle is equal to or higher than a first threshold, the previously detected vehicle being detected at time prior to imaging time of the captured image at a position of the probe vehicle at the imaging time.

5. The information processing apparatus according to claim 1, wherein the one or more processors detect a vehicle-line pattern from the captured image, the vehicle-line pattern representing a shape of an entire vehicle-line including the vehicle, and the parked-vehicle conditions include a parked-vehicle condition that a level of match between the vehicle-line pattern and a previously detected vehicle-line pattern by another probe vehicle is equal to or higher than a second threshold, the previously detected vehicle-line pattern being detected at time prior to imaging time of the captured image at a position of the probe vehicle at the imaging time.

6. The information processing apparatus according to claim 1, wherein the one or more processors measure an inter-vehicle distance between the vehicle and another vehicle ahead of the vehicle, the stopped-vehicle conditions include a stopped-vehicle condition that the inter-vehicle distance is equal to or smaller than a third threshold, and the parked-vehicle conditions include a parked-vehicle condition that the inter-vehicle distance is equal to or larger than a fourth threshold larger than the third threshold.

7. The information processing apparatus according to claim 1, wherein the one or more processors detect a lane from the captured image, determine a position of the vehicle in the lane, the stopped-vehicle conditions include a stopped-vehicle condition that the vehicle is located near a center of the lane, and the parked-vehicle conditions include a parked-vehicle condition that the vehicle is located closer to a shoulder of the lane.

8. The information processing apparatus according to claim 1, wherein the one or more processors detect an on/off status of lighting that is mounted on the vehicle, the stopped-vehicle conditions include a stopped-vehicle condition that a brake lamp or a tail lamp of the lighting is on, and the parked-vehicle conditions include a parked-vehicle condition that a hazard lamp of the lighting is flashing.

9. The information processing apparatus according to claim 1, wherein the stopped-vehicle conditions include a stopped-vehicle condition that a position of the probe vehicle at imaging time of the captured image is near a traffic light or a railroad crossing, and the parked-vehicle conditions include a parked-vehicle condition that a position of the probe vehicle at the imaging time is near a parking meter.

10. The information processing apparatus according to claim 1, further comprising:

a storage that stores a result of the determination by the one or more processors, the captured image, imaging time of the captured image, and a position of the probe vehicle at the imaging time, in association with one another, wherein the one or more processors output the captured image and the result of the determination from the storage, in association with one another.

11. The information processing apparatus according to claim 10, wherein, when the one or more processors determine the vehicle as a parked vehicle, and a distance between a no-parking area and a position of the probe vehicle at imaging time at which the imaging device has captured the vehicle is equal to or smaller than a fifth threshold, the one or more processors output a notification that the vehicle is likely to be a parked vehicle in the no-parking area.

12. An information processing system comprising:

an onboard device in a probe vehicle; and an information processing apparatus that is connected to the onboard device over a network;

a vehicle detector that detects a vehicle from a captured image by an imaging device that is mounted on the probe vehicle;

either of the onboard device and the information processing apparatus comprising one or more processors configured to:

determine whether the detected vehicle is running;

calculate, when the vehicle is not running, a sum of points associated with each of stopped-vehicle conditions satisfied by the vehicle detected from the captured image, as a stopped-vehicle evaluation value, the stopped-vehicle evaluation value indicating a possibility of the vehicle being a stopped vehicle, the stopped-vehicle conditions defining characteristics of a stopped vehicle that remains at a stop for a given length of time being less than a given threshold;

calculate, when the vehicle is not running, a sum of points associated with each of parked-vehicle conditions satisfied by the vehicle detected from the captured image, as a parked-vehicle evaluation value, the parked-vehicle evaluation value indicating a possibility of the vehicle being a parked vehicle, the parked-vehicle conditions defining characteristics of a parked vehicle that remains at a stop for a given length of time being equal to or more than the threshold; and determine whether the vehicle is a stopped vehicle or a parked vehicle based on the stopped-vehicle evaluation value and the parked-vehicle evaluation value, wherein the points associated with each of the stopped-vehicle conditions or the parked-vehicle conditions are different values depending on the importance of the stopped-vehicle conditions or the parked-vehicle conditions.

13. An information processing method comprising:

detecting a vehicle from a captured image by an imaging device that is mounted in a probe vehicle;

determining whether the detected vehicle is running;

calculating, when the vehicle is not running, a sum of points associated with each of stopped-vehicle conditions satisfied by the vehicle detected from the captured image, as a stopped-vehicle evaluation value, the stopped-vehicle evaluation value indicating a possibility of the vehicle being a stopped vehicle, the stopped-vehicle conditions defining characteristics of a stopped vehicle that remains at a stop for a given length of time being less than a given threshold;

calculating, when the vehicle is not running, a sum of points associated with each of parked-vehicle conditions satisfied by the vehicle detected from the captured image, as a parked-vehicle evaluation value, the parked-vehicle evaluation value indicating a possibility of the vehicle being a parked vehicle, the parked-vehicle conditions defining characteristics of a parked vehicle that remains at a stop for a given length of time being equal to or more than the threshold, and determining whether the vehicle is a stopped vehicle or a parked vehicle based on the stopped-vehicle evaluation value and the parked-vehicle evaluation value, wherein the points associated with each of the stopped-vehicle conditions or the parked-vehicle conditions are different values depending on the importance of the stopped-vehicle conditions or the parked-vehicle conditions.

* * * * *